US007525499B2

(12) United States Patent
Kanno

(10) Patent No.: US 7,525,499 B2
(45) Date of Patent: Apr. 28, 2009

(54) DIFFERENTIALLY-FED VARIABLE DIRECTIVITY SLOT ANTENNA

(75) Inventor: Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/147,070

(22) Filed: Jun. 26, 2008

(65) Prior Publication Data

US 2009/0002250 A1 Jan. 1, 2009

Related U.S. Application Data

(63) Continuation of application No. PCT/JP2008/050553, filed on Jan. 17, 2008.

(30) Foreign Application Priority Data

Jan. 24, 2007 (JP) ..... 2007-013315

(51) Int. Cl.
*H01Q 13/10* (2006.01)

(52) U.S. Cl. ..... 343/770; 343/767; 343/768; 343/846

(58) Field of Classification Search ..... 343/770, 343/767, 768, 846
See application file for complete search history.

(56) References Cited

U.S. PATENT DOCUMENTS 6,664,931 B1 * 12/2003 Nguyen et al. ..... 343/767
6,765,450 B2 7/2004 Howard et al.
6,864,848 B2 * 3/2005 Sievenpiper ..... 343/767
7,002,519 B2 * 2/2006 Wang et al. ..... 343/702
7,167,136 B2 1/2007 Thudor et al.
2003/0122721 A1 7/2003 Sievenpiper
2005/0200530 A1 9/2005 Aikawa et al.
2005/0237252 A1 10/2005 Thudor et al.
2006/0012536 A1 1/2006 Thudor et al.
2008/0272972 A1 * 11/2008 Kanno et al. ..... 343/767
2008/0284671 A1 * 11/2008 Kanno ..... 343/767

FOREIGN PATENT DOCUMENTS

JP 5-267923 10/1993
JP 2004-129234 4/2004
JP 2004-274757 9/2004

(Continued)

OTHER PUBLICATIONS

Garg, R., et al., "Microstrip Slot Antennas", Microstrip Antenna Design Handbook, 2001, pp. 441-443, Artech House, Inc.

(Continued)

*Primary Examiner*—Tho G Phan
(74) *Attorney, Agent, or Firm*—McDermott Will & Emery LLP

(57) ABSTRACT

Opposite ends open slot resonators (601, 605) having a slot length during an operation set to become one half of effective wavelength are operated by a differential feeder liner (103*c*) and a slot resonator group excited with a reverse phase/equal amplitude is made to emerge in the circuit, and arrangement conditions of the open end points of selective radiation parts (601*b*, 601*c*, 603*b*, 603*c*, 605*b*, 605*c*, 607*b*, 607*c*) in each slot structure are switched dynamically.

9 Claims, 24 Drawing Sheets

FOREIGN PATENT DOCUMENTS

| | | |
|---|---|---|
| JP | 2004-304226 | 10/2004 |
| JP | 2005-514844 | 5/2005 |
| JP | 2005-217667 | 8/2005 |
| JP | 2006-033837 | 2/2006 |
| JP | 2006-042042 | 2/2006 |
| JP | 2006-157176 | 6/2006 |
| JP | 2006-310927 | 11/2006 |

OTHER PUBLICATIONS

Gisin, F., et al., "Routing Differential I/O Signals Across Split Ground Planes at the Connector for EMI Control", IEEE International Symposium on Electromagnetic Compatibility, Digest, 2000, pp. 325-327, vol. 1 No. 21-25, IEEE.

Co-pending U.S. Application: Continuation Application of PCT/JP2007/072754 filed on Jun. 26, 2008.

* cited by examiner

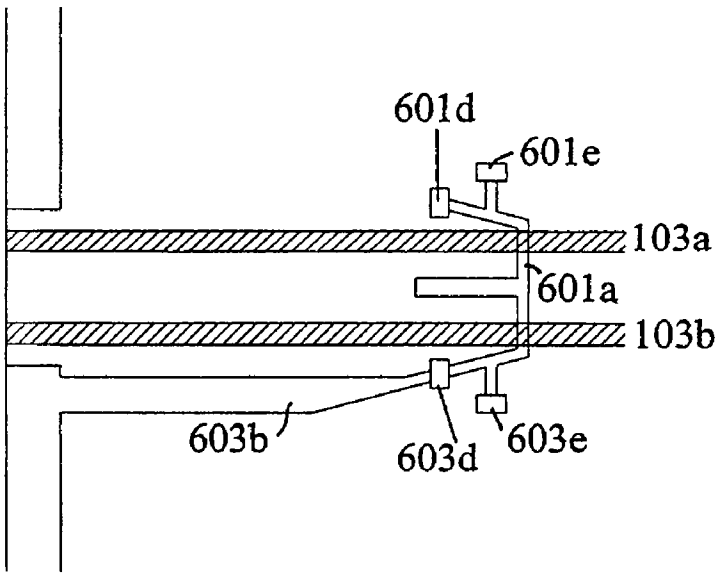
FIG.5B
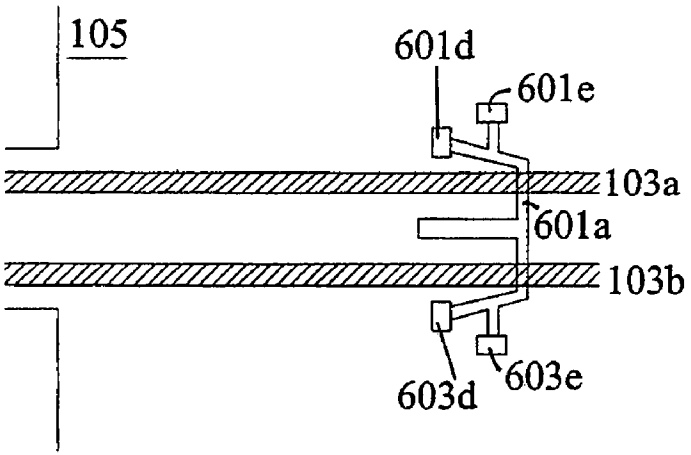
FIG.5A
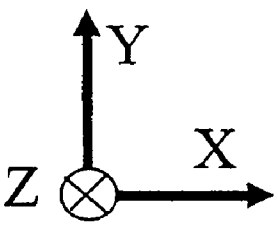

XY-plane

XZ-plane

YZ-plane

YZ-plane

XZ-plane

XY-plane

XY-plane

XZ-plane

YZ-plane

YZ-plane

XZ-plane

XY-plane

XY-plane

XZ-plane

YZ-plane

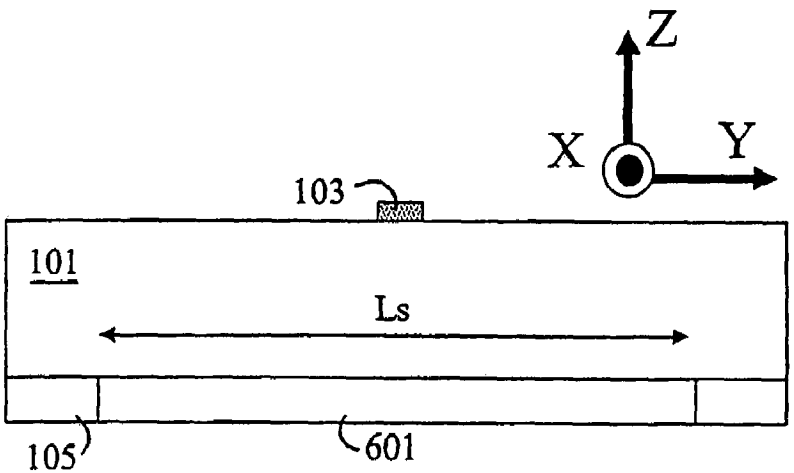
FIG.17B -- PRIOR ART --
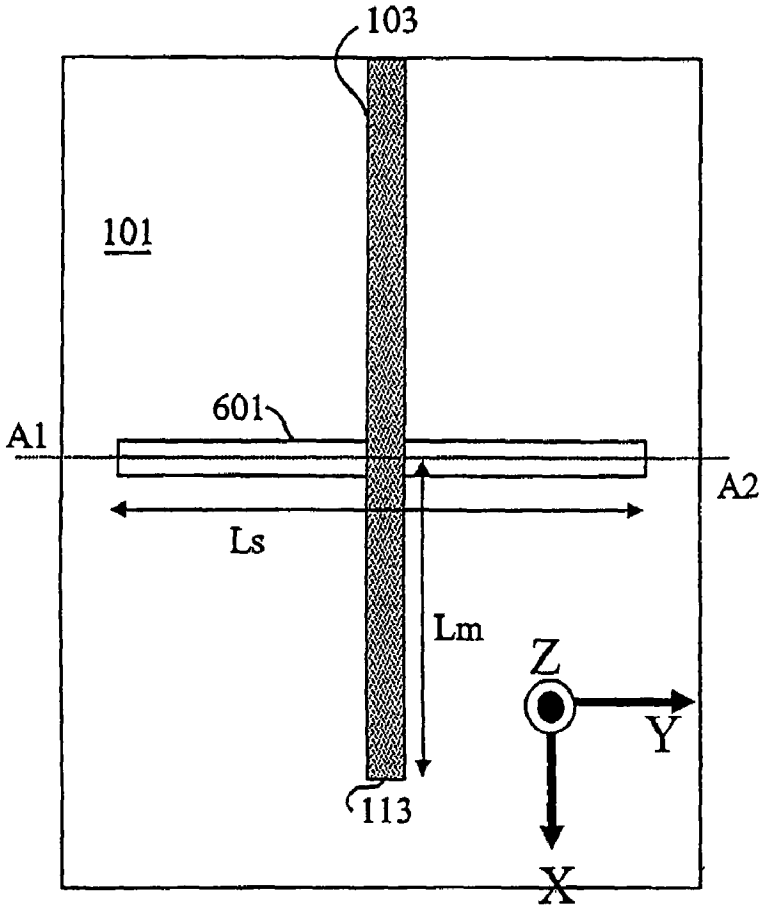
FIG.17A -- PRIOR ART --

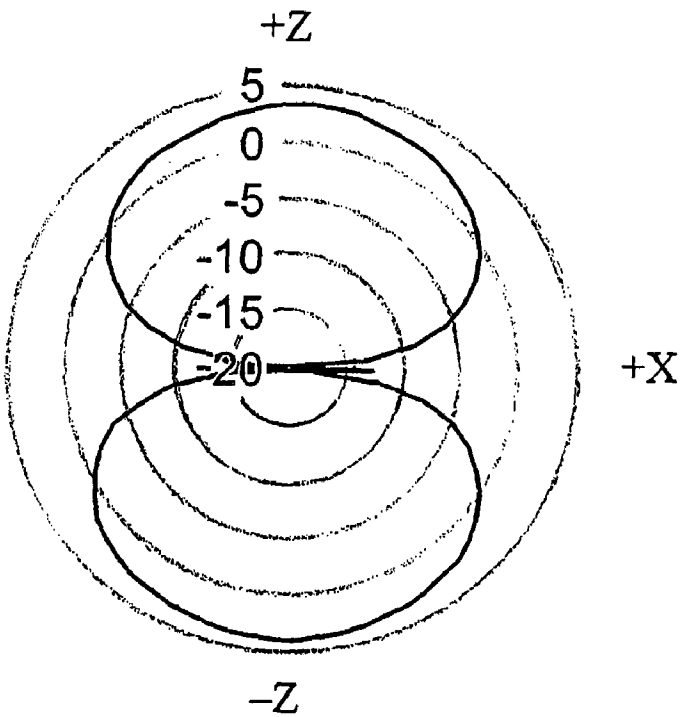
XZ-plane
*FIG. 18B-- PRIOR ART --*
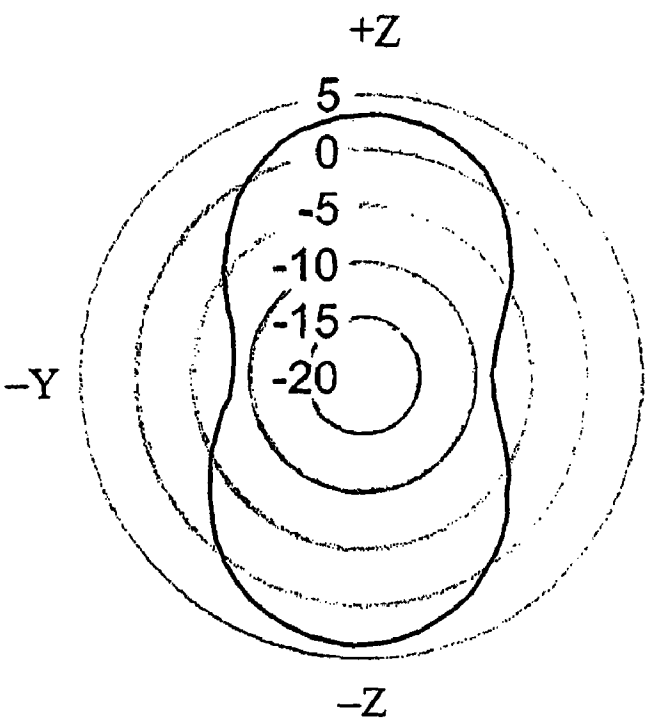
YZ-plane
*FIG. 18A-- PRIOR ART --*

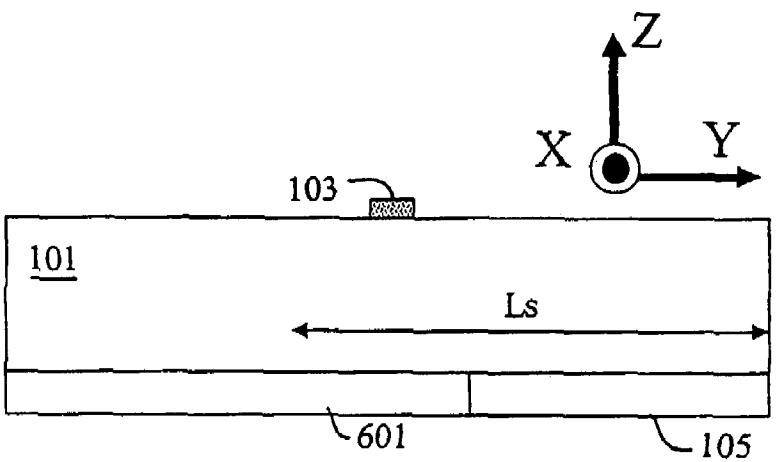
FIG. 19B -- PRIOR ART --
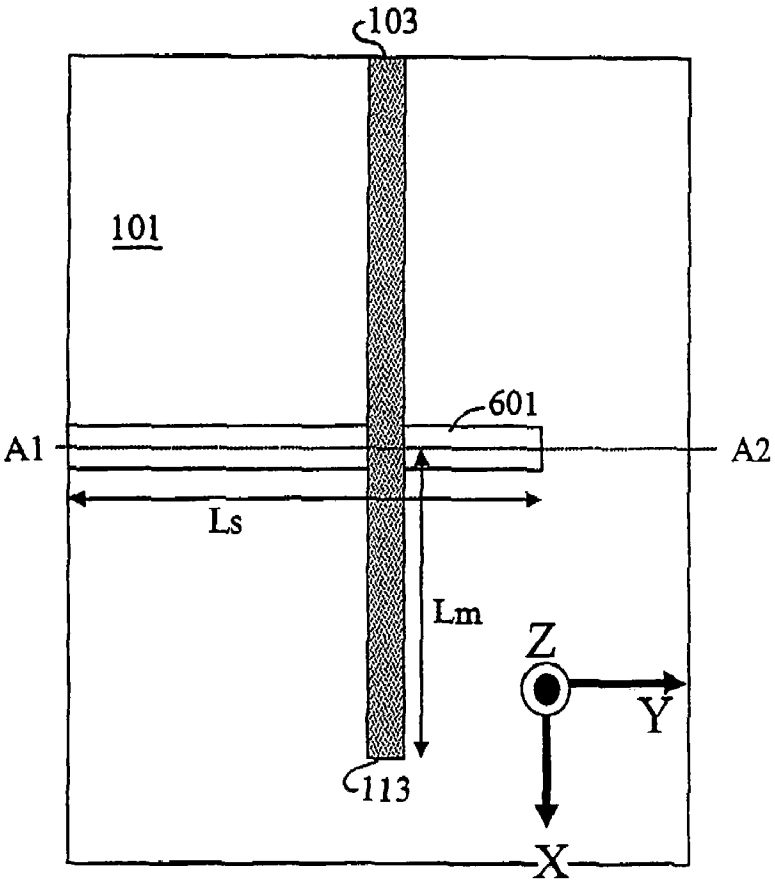
FIG. 19A -- PRIOR ART --

YZ-plane

-- PRIOR ART --

XZ-plane

-- PRIOR ART --

XY-plane

-- PRIOR ART --

-- PRIOR ART --

-- PRIOR ART --

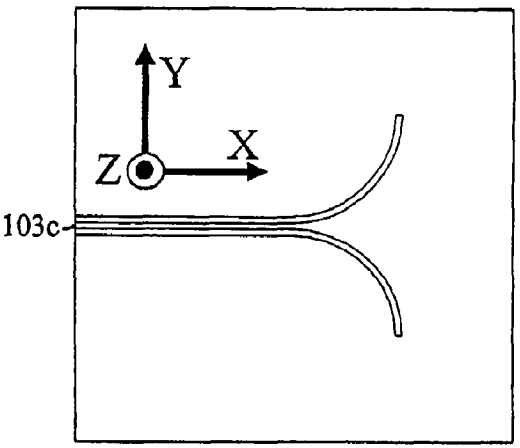
FIG.22B -- PRIOR ART --
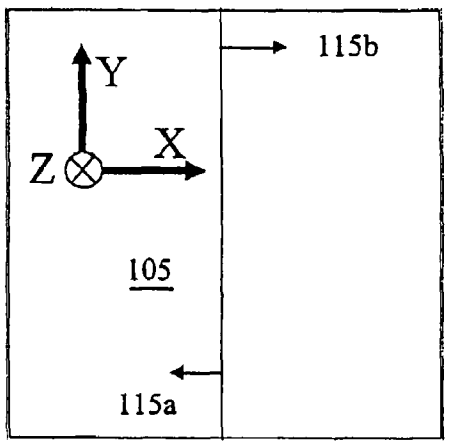
FIG.22C -- PRIOR ART --
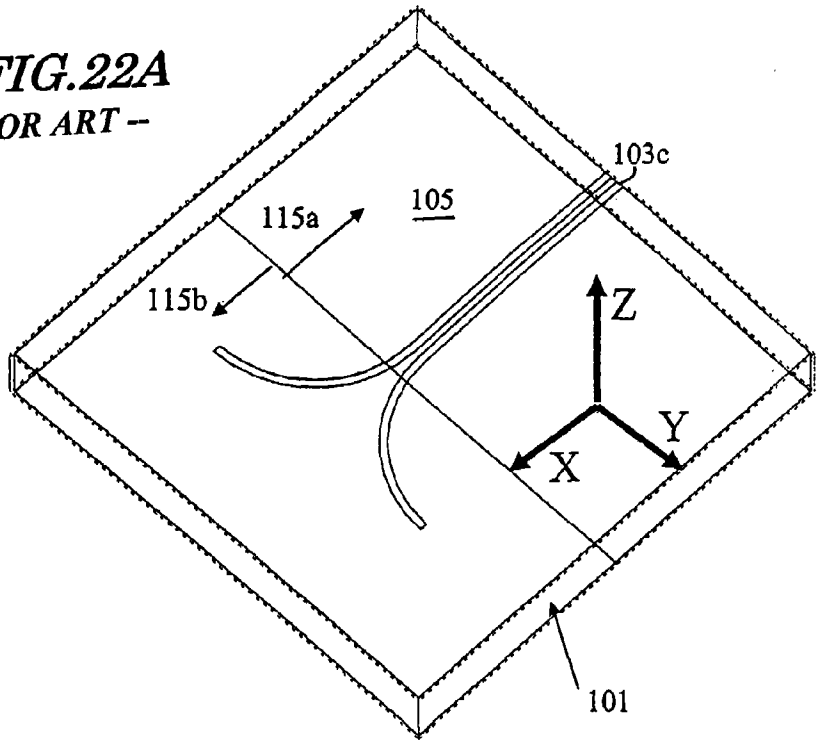
FIG.22A
-- PRIOR ART --

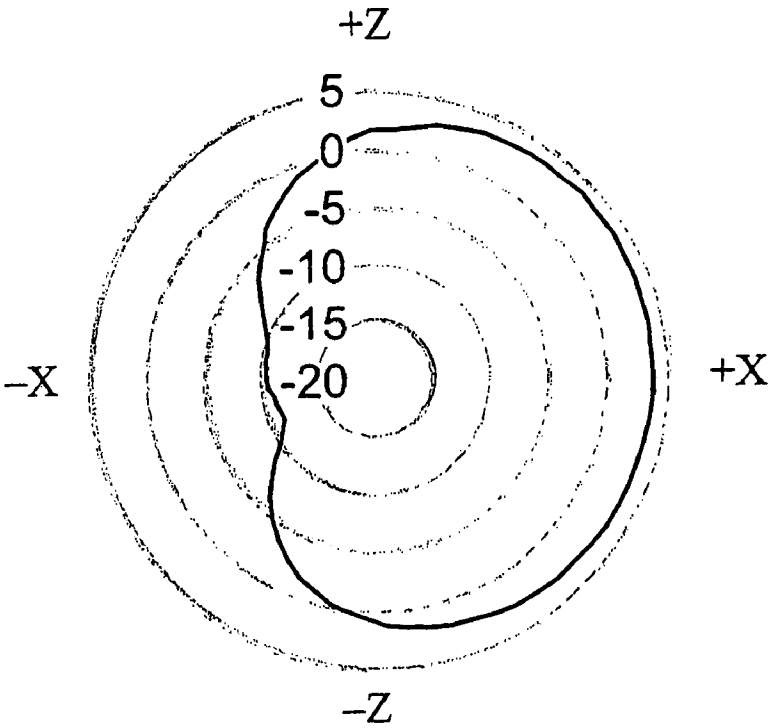
XZ-plane
*FIG.23B* – *PRIOR ART* –
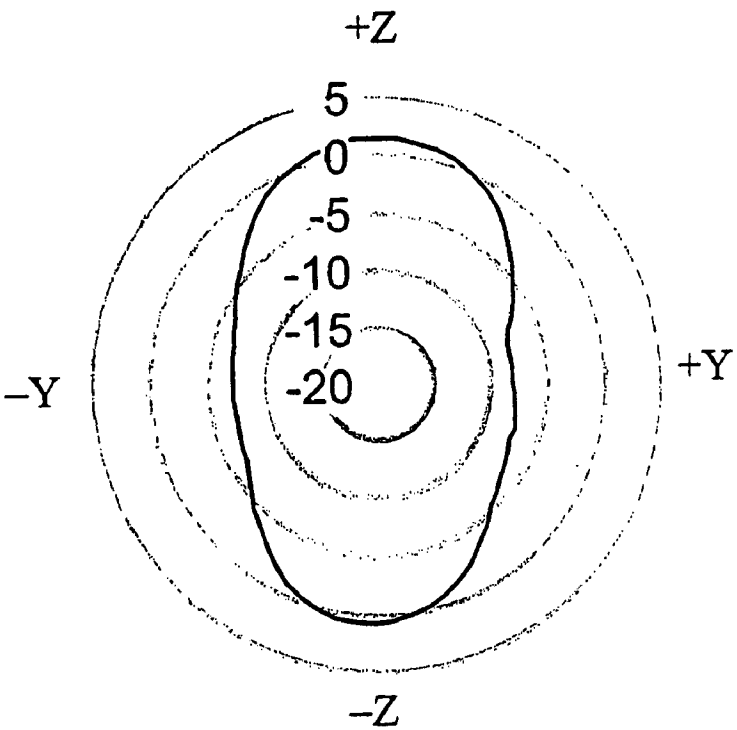
YZ-plane
*FIG.23A* – *PRIOR ART* –

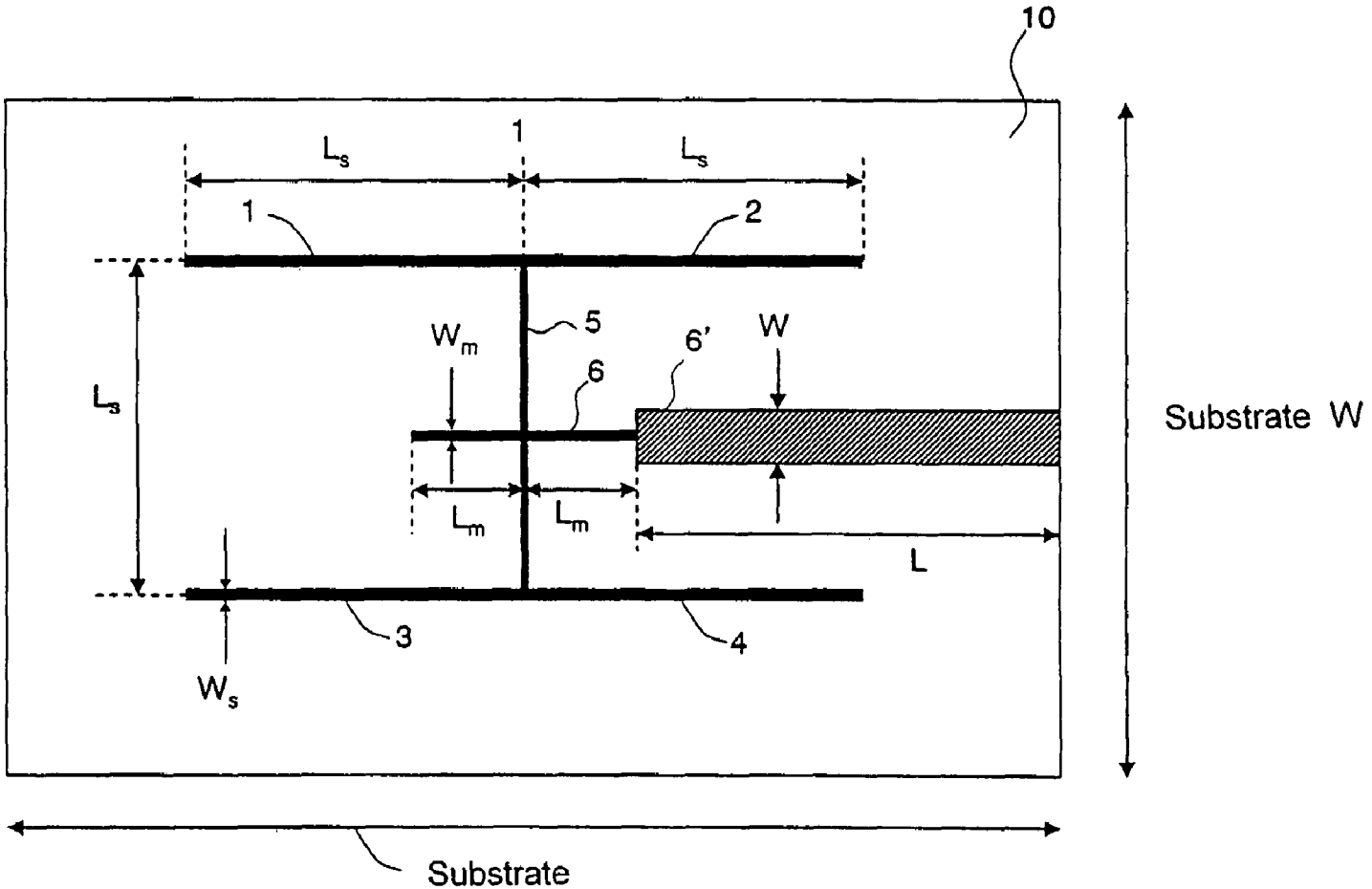
FIG.24 – PRIOR ART –

DIFFERENTIALLY-FED VARIABLE DIRECTIVITY SLOT ANTENNA

This is a continuation of International Application No. PCT/JP2008/050553, with an international filing date of Jan. 17, 2008, which claims priority of Japanese Patent Application No. 2007-013315, filed on Jan. 24, 2007, the contents of which are hereby incorporated by reference.

BACKGROUND OF THE INVENTION

1. Field of the Invention

The present invention relates to a differentially-fed antenna with which a digital signal or an analog high-frequency signal, e.g., that of a microwave range or an extremely high frequency range, is transmitted or received.

2. Description of the Related Art

In recent years, drastic improvements in the characteristics of silicon-type transistors have led to an accelerated trend where compound semiconductor transistors are being replaced by silicon-type transistors not only in digital circuitry but also in analog high-frequency circuitry, and where analog high-frequency circuitry and digital baseband circuitry are being made into a single chip. As a result of this, single-ended circuits (which have been in the mainstream of high-frequency circuits) are being replaced by differential signal circuits which undergo a balanced operation of signals of positive and negative signs. This is because a differential signal circuit provides advantages such as drastic reduction in unwanted radiation, obtainment of good circuit characteristics under conditions which do not allow an infinite area of ground conductor to be disposed within a mobile terminal device, and so on. The individual circuit elements in a differential signal circuit need to operate under a balance. Silicon-type transistors do not have much variation in characteristics, and make it possible to maintain a differential balance between signals. Another reason is that differential lines are also preferable for avoiding the loss that is associated with the silicon substrate itself. This has resulted in a strong desire for high-frequency devices, such as antennas and filters, to support differential signal feeding while maintaining the high high-frequency characteristics that have been established in single-ended circuits.

FIG. 17A shows a schematic see-through view as seen from the upper face, and FIG. 17B shows a cross-sectional structural diagram taken along line A1-A2 in the figure; this is a ½ wavelength slot antenna (Conventional Example 1) which is fed through a single-ended line 103. On a ground conductor surface 105 which is formed on the rear face of a dielectric substrate 101, a slot resonator 601 having a slot length Ls corresponding to a ½ effective wavelength is formed. In order to satisfy the input matching conditions, a distance Lm from an open-end point 113 of the single-ended line 103 until intersecting the slot 601 is set to a ¼ effective wavelength at the operating frequency. The slot resonator 601 is obtained by removing the conductor completely across the thickness direction in a partial region of the ground conductor surface 105. As shown in the figure, a coordinate system is defined in which a direction that is parallel to a transmission direction in the feed line is the X axis and the plane of the dielectric substrate is the XY plane. Typical examples of radiation directivity characteristics of Conventional Example 1 are shown in FIGS. 18A and 18B. FIG. 18A shows a radiation directivity in the YZ plane, whereas FIG. 18B shows a radiation directivity in the XZ plane. As is clear from these figures, Conventional Example 1 provides radiation directivity characteristics that exhibit a maximum gain in the ±Z direction. Moreover, null characteristics are obtained in the ±X direction, and even in the ±Y direction, a gain reduction effect of about 10 dB relative to the main beam direction is obtained.

On the other hand, FIG. 19A shows a schematic see-through view as seen from the upper face, and FIG. 19B shows a cross-sectional structural diagram taken along line A1-A2 in the figure; this is a ¼ wavelength slot antenna (Conventional Example 2) which is fed through a single-ended line 103. On a ground conductor 105 having an finite area and being formed on the rear face of a dielectric substrate 101, a slot resonator 601 having a slot length Ls corresponding to a ¼ effective wavelength is formed. The slot resonator is left open-ended at an edge of the ground conductor 105. FIG. 20A shows a radiation directivity in the YZ plane; FIG. 20B shows a radiation directivity in the XZ plane; and FIG. 20C shows a radiation directivity in the XY plane. As is clear from these figures, Conventional Example 2 provides broad radiation directivity characteristics that exhibit a maximum gain in the −Y direction.

U.S. Pat. No. 6,765,450 (hereinafter "Patent Document 1") discloses a circuit structure in which the aforementioned slot structure is disposed immediately under a differential feed line so as to be orthogonal to the transmission direction (Conventional Example 3). That is, the circuit construction of Patent Document 1 is a construction in which the circuit for feeding the slot resonator is changed from a single-ended line to a differential feed line. Patent Document 1 has an objective to realize a function of selectively reflecting only an unwanted in-phase signal that has been unintentionally superposed on a differential signal. As is clear from this objective, the circuit structure disclosed in Patent Document 1 does not have a function of radiating a differential signal into free space.

FIGS. 21A and 21B schematically illustrate field distributions occurring in a ½ wavelength slot resonator in the cases where it is fed through a single-ended line and a differential feed line, respectively. In the case of the slot being fed through a single-ended line, electric fields 201 are distributed along the slot width direction so that a minimum intensity exists at both ends and a maximum intensity exists in the central portion. On the other hand, in the case of the slot being fed through a differential feed line, electric fields 201*a* which occur in the slot due to a voltage of the positive sign and electric fields 201*b* which occur in the slot due to a voltage of the negative sign are at an equal intensity and have vectors in opposite directions. Thus, in total, both electric fields cancel out each other. Therefore, even the ½ wavelength slot resonator is fed through a differential feed line, efficient radiation of electromagnetic waves would be impossible according to principles. Similarly, if the ½ wavelength slot resonator is replaced by a ¼ wavelength slot resonator, it still holds that out-of-phase voltages being fed from excitation points in a near proximity would cancel out each other, thus hindering efficient radiation. Therefore, as compared to the case of feeding via a single-ended line, it is not easy to realize practical antenna characteristics by allowing a differential feed line to couple to a slot resonator structure.

Non-Patent Document 2 ("Routing differential I/O signals across split ground planes at the connector for EMI control" IEEE International Symposium on Electromagnetic Compatibility, Digest Vol. 1 21-25 pp. 325-327 August 2000) reports that, by splitting a ground conductor on the rear face of a differential line to form a slot structure with open ends, elimination of the in-phase mode which has been unintentionally superposed on the line becomes possible. Clearly in this case, too, the objective is not meant to be an efficient radiation of differential signal components.

In general, in order to efficiently radiate electromagnetic waves from a differential transmission circuit, no slot resonator is used. Rather, a method is employed in which the interspace between two signal lines of a differential feed line is increased to realize an operation as a dipole antenna (Conventional Example 4). FIG. 22A shows a perspective schematic see-through view of a differentially-fed strip antenna; FIG. 22B shows an upper schematic view thereof; and FIG. 22C shows a lower schematic view thereof. In FIGS. 22A to 22C, coordinate axes are set similarly to FIG. 17. In a differentially-fed strip antenna, the line interspace of a differential feed line 103*c* which is formed on the upper face of a dielectric substrate 101 has a tapered increase at the ends. At the rear face side of the dielectric substrate 101, a ground conductor 105 is formed in a region 115*a* which is closer to the input terminal, whereas no ground conductor is formed in a region 115*b* lying immediately under the ends of the differential feed line 103*c*. Typical examples of radiation directivity characteristics of Conventional Example 4 are shown in FIGS. 23A and 23B. FIG. 23A shows radiation directivity characteristics in the YZ plane, whereas FIG. 23B shows radiation directivity characteristics in the XZ plane. As is clear from these figures, in Conventional Example 4, the main beam direction is the ±X direction, and Conventional Example 4 exhibits radiation characteristics with a broad half-width distributed over the XZ plane. According to principles, no radiation gain in the ±Y direction is obtained in Conventional Example 4. Due to reflection by the ground conductor 105, radiation in the minus X direction can be suppressed.

On the other hand, Japanese Laid-Open Patent Publication No. 2004-274757 (hereinafter "Patent Document 2"; Conventional Example 5) discloses a variable slot antenna which is fed through a single-ended line. FIG. 1 of Patent Document 2 is shown herein as FIG. 24. This construction is similar to Conventional Example 1 in that a ½ wavelength slot resonator 5 which is formed on the substrate rear face is fed through a single-ended line 6 which is disposed on the front face of the dielectric substrate 10. However, at the leading end of the ½ wavelength slot resonator 5 being fed, a plurality of ½ wavelength slot resonators 1, 2, 3, and 4 are further provided for selective connection, thus realizing highly-free slot resonator positioning. It is described that changing the slot resonator positioning realizes a function of changing the main beam direction of electromagnetic waves. See also Artech House Publishers "Microstrip antenna Design Handbook" pp. 441-pp. 443 2001 ("Non-Patent Document 1").

Conventional differentially-fed antennas, slot antennas, and variable antennas have the following problems associated with their principles.

Firstly, in Conventional Example 1, the main beam can only be directed in the ±Z axis direction, and it is difficult to direct the main beam direction in the ±Y axis direction or the ±X axis direction. What is more, since differential feeding is not yet supported, it is necessary to employ a balun circuit for feed signal conversion, thus resulting in the problems of increased elements, hindrance of integration, and the like.

Secondly, in Conventional Example 2, although a broad main beam in the +Y direction is formed, it is difficult to form beams in any other directions. What is more, since differential feeding is not yet supported, it is necessary to employ a balun circuit for feed signal conversion, thus resulting in the problems of increased elements, hindrance of integration, and the like. Moreover, the radiation characteristics of Conventional Example 2 have a broad half-width, which makes it difficult to avoid deterioration in quality of communications. For example, if a desired signal comes in the −Y direction, the reception intensity of any unwanted signal that comes in the +X direction will not be suppressed. Thus, it is very difficult to avoid serious multipath problems which may occur when performing high-speed communications in an indoor environment with a lot of signal returns, and maintain the quality of communications in a situation where a lot of interference waves may arrive.

Thirdly, as described with respect to Conventional Example 3, only non-radiation characteristics can be attained by a ½ wavelength slot resonator or a ¼ wavelength slot resonator in which feeding via a single-ended line is merely replaced with feeding via a differential feed line. Thus, it is difficult to obtain an efficient antenna operation.

Fourthly, with Conventional Example 4, it is difficult to direct the main beam in the ±Y axis direction. Note that bending the feed line in order to deflect the main beam direction is not an available solution in Conventional Example 4 because, if the differential line is bent, the reflection of an unwanted in-phase signal will occur due to a phase difference between the two wiring lines at the bent portion. As an antenna for a mobile terminal device to be used in an indoor environment, it is highly unpreferable that the main beam cannot be directed in a certain direction.

Fifthly, the radiation characteristics of Conventional Example 4 have a broad half-width, which makes it difficult to avoid deterioration in quality of communications. For example, if a desired signal comes in the Z axis direction, the reception intensity of any unwanted signal that comes in the +X direction will not be suppressed. Thus, it is very difficult to avoid serious multipath problems which may occur when performing high-speed communications in an indoor environment with a lot of signal returns, and maintain the quality of communications in a situation where a lot of interference waves may arrive.

Sixthly, as in the aforementioned fourth problem, it is also difficult in Conventional Example 5 to prevent the quality of communications from being unfavorably affected by an unwanted signal coming in a direction which is different from the direction in which a desired signal arrives. In other words, even if the main beam direction is controllable, there is still a problem of inadequate suppression of interference waves. Of course, as in the aforementioned first problem, differential feeding is not yet supported.

In summary, by using any of the conventional techniques, it is impossible to realize a variable antenna which solves the following three problems: 1) affinity with differential feed circuitry; 2) ability to switch the main beam direction within a wide range of solid angles; and 3) suppression of interference waves coming in any direction other than the main beam direction.

SUMMARY OF THE INVENTION

It is an objective of the present invention to provide a variable antenna which solves the aforementioned three conventional problems, and which preferably has characteristics such that a plurality of radiation patterns that are obtained through variable control act in a complementary manner to encompass all solid angles.

A differentially-fed variable directivity slot antenna according to the present invention is a differentially-fed variable directivity slot antenna comprising: a dielectric substrate (101); a ground conductor (105) provided on a rear face of the dielectric substrate (101), the ground conductor having a finite area; a differential feed line (103*c*) disposed on a front face of the dielectric substrate (101), the differential feed line having two mirror symmetrical signal conductors (103*a*, 103*b*); and at least one slot structure (601, 605), wherein, the at least one slot structure (601, 605) is formed on the rear face of the dielectric substrate (101); the at least one slot structure (601, 605) each includes a feeding portion (601*a*, 605*a*), a first selective radiation portion group, and a second selective radiation portion group; the first selective radiation portion group includes at least one first selective radiation portion (601*b*, 601*c*, 605*b*, 605*c*); the second selective radiation portion group includes at least one second selective radiation portion (603*b*, 603*c*, 607*b*, 607*c*); the feeding portion (601*a*, 605*a*) includes a slot provided on the rear face of the dielectric substrate (101); the at least one first selective radiation portion (601*b*, 601*c*, 605*b*, 605*c*) each includes a slot provided on the rear face of the dielectric substrate; the at least one second selective radiation portion (603*b*, 603*c*, 607*b*, 607*c*) each includes a slot provided on the rear face of the dielectric substrate; the feeding portion (601*a*, 605*a*) intersects both signal conductors (103*a*, 103*b*); the at least one first selective radiation portion (601*b*, 601*c*, 605*b*, 605*c*) is each connected to one end of the feeding portion (601*a*, 605*a*); a leading end of each of the at least one first selective radiation portion (601*b*, 601*c*, 605*b*, 605*c*) is an open-end point (601*bop*, 601*cop*, 605*bop*, 605*cop*) which is left open; the at least one second selective radiation portion (603*b*, 603*c*, 607*b*, 607*c*) is each connected to another end of the feeding portion (601*a*, 605*a*); a leading end of each of the at least one second selective radiation portion (603*b*, 603*c*, 607*b*, 607*c*) is an open-end point (603*bop*, 603*cop*, 607*bop*, 607*cop*) which is left open; and the at least one slot structure (601, 605) has at least one function of an RF structure reconfigurability function and an operation status switching function, thus realizing two or more different radiation directivities. In between places where the feeding portion intersects the signal conductors (103*a*, 103*b*), the feeding portion (601*a*, 605*a*) further includes a stub (601*s*, 605*s*) having a length which is less than a ⅛ effective wavelength at an operating frequency fo; between the one end of the feeding portion (601*a*, 605*a*) and the at least one first selective radiation portion (601*b*, 601*c*, 605*b*, 605*c*), a high-frequency switch (601*d*, 601*e*, 605*d*, 605*e*) is inserted so as to straddle the slot structure (601, 605) along a width direction; between the other end of the feeding portion (601*a*, 605*a*) and the at least one second selective radiation portion (603*b*, 603*c*, 607*b*, 607*c*), a high-frequency switch (603*d*, 603*e*, 607*d*, 607*e*) is inserted so as to straddle the slot structure (601, 605) along the width direction; each high-frequency switch (601*d*, 601*e*, 603*d*, 603*e*, 605*d*, 605*e*, 607*d*, 607*e*) provides control as to whether or not to short-circuit the ground conductor (105) on both sides bridged by the high-frequency switch; the RF structure reconfigurability function is realized when a slot resonator with open both ends is formed by the first selective radiation portion (601*b*, 601*c*, 605*b*, 605*c*) selected via the high-frequency switch from within the first selective radiation portion group, the feeding portion, and the second selective radiation portion (603*b*, 603*c*, 607*b*, 607*c*) selected via the high-frequency switch from within the second selective radiation portion group, the slot resonator with open both ends having a slot length corresponding to a ½ effective wavelength at the operating frequency fo; and the operation status switching function is realized by the high-frequency switches short-circuiting the slot structure.

In a preferred embodiment, the differential feed line intersects the feeding portion at a point whose distance from an open end of the differential feed line toward the feed circuit corresponds to a ¼ effective wavelength at the operating frequency.

In a preferred embodiment, an end point of the differential feed line is grounded via resistors of a same resistance value.

In a preferred embodiment, an end point of the first signal conductor and an end point of the second signal conductor are electrically connected to each other via a resistor.

In a preferred embodiment, the differentially-fed variable directivity slot antenna has two slot structures, wherein, a plane parallel to the dielectric substrate (101) is defined as an XY plane; a normal direction of the dielectric substrate (101) is defined as a Z axis direction; the XY plane includes an X axis and a Y axis which are orthogonal to each other; in each slot structure (601•605), the first selective radiation portion group includes a selective radiation portion (601*b*•605*b*) parallel to the X axis and a selective radiation portion (601*c*•605*c*) parallel to the Y axis; in each slot structure (601•605), the second selective radiation portion group includes a selective radiation portion (603*b*•607*b*) parallel to the X axis and a selective radiation portion (603*c*•607*c*) parallel to the Y axis; the open-end point (601*bop*) of the selective radiation portion (601*b*) which is included in the first selective radiation portion group in the first slot structure (601) and which is parallel to the X axis and the open-end point (603*bop*) of the selective radiation portion (603*b*) which is included in the second selective radiation portion group in the first slot structure (601) and which is parallel to the X axis are disposed at a distance of less than a ¼ effective wavelength at the frequency fo from each other; the open-end point (605*bop*) of the selective radiation portion (605*b*) which is included in the first selective radiation portion group in the second slot structure (605) and which is parallel to the X axis and the open-end point (607*bop*) of the selective radiation portion (607*b*) which is included in the second selective radiation portion group in the second slot structure (605) and which is parallel to the X axis are disposed at a distance of less than a ¼ effective wavelength at the frequency fo from each other; the open-end point (601*bop*) of the selective radiation portion (601*b*) which is included in the first selective radiation portion group in the first slot structure (601) and which is parallel to the X axis and the open-end point (605*bop*) of the selective radiation portion (605*b*) which is included in the first selective radiation portion group in the second slot structure (605) and which is parallel to the X axis are disposed so as to be apart by about ½ effective wavelength at the frequency fo; and the open-end point (603*bop*) of the selective radiation portion (603*b*) which is included in the second selective radiation portion group in the first slot structure (601) and which is parallel to the X axis and the open-end point (607*bop*) of the selective radiation portion (607*b*) which is included in the second selective radiation portion group in the second slot structure (605) and which is parallel to the X axis are disposed so as to be apart by about ½ effective wavelength at the frequency fo, whereby one of the two or more different radiation directivities is realized, wherein the one radiation directivity is a radiation directivity being orthogonal to the differential feed line and having radiation components in two directions which are parallel to the dielectric substrate.

In a preferred embodiment, the differentially-fed variable directivity slot antenna has two slot structures, wherein, a plane parallel to the dielectric substrate (101) is defined as an XY plane; a normal direction of the dielectric substrate (101) is defined as a Z axis direction; the XY plane includes an X axis and a Y axis which are orthogonal to each other; in each slot structure (601•605), the first selective radiation portion group includes a selective radiation portion (601*b*•605*b*) parallel to the X axis and a selective radiation portion (601*c*•605*c*) parallel to the Y axis; in each slot structure (601•605), the second selective radiation portion group includes a selective radiation portion (603*b*•607*b*) parallel to the X axis and a selective radiation portion (603*c*•607*c*) parallel to the Y axis; the open-end point (601*cop*) of the selective radiation portion (601*c*) which is included in the first selective radiation portion group in the first slot structure (601) and which is parallel to the Y axis and the open-end point (603*cop*) of the selective radiation portion (603*c*) which is included in the second selective radiation portion group in the first slot structure (601) and which is parallel to the Y axis are disposed so as to be apart by about ½ effective wavelength at the frequency fo; the open-end point (605*cop*) of the selective radiation portion (605*c*) which is included in the first selective radiation portion group in the second slot structure (605) and which is parallel to the Y axis and the open-end point (607*cop*) of the selective radiation portion (607*c*) which is included in the second selective radiation portion group in the second slot structure (605) and which is parallel to the Y axis are disposed so as to be apart by about ½ effective wavelength at the frequency fo; the open-end point (601*cop*) of the selective radiation portion (601*c*) which is included in the first selective radiation portion group in the first slot structure (601) and which is parallel to the Y axis and the open-end point (605*cop*) of the selective radiation portion (605*c*) which is included in the first selective radiation portion group in the second slot structure (605) and which is parallel to the Y axis are disposed at a distance of less than a ¼ effective wavelength at the frequency fo from each other; and the open-end point (603*cop*) of the selective radiation portion (603*c*) which is included in the second selective radiation portion group in the first slot structure (601) and which is parallel to the Y axis and the open-end point (607*cop*) of the selective radiation portion (607*c*) which is included in the second selective radiation portion group in the second slot structure (605) and which is parallel to the Y axis are disposed at a distance of less than a ¼ effective wavelength at the frequency fo from each other, whereby one of the two or more different radiation directivities is realized, wherein the one radiation directivity is a radiation directivity having radiation components in two directions which are parallel to the differential feed line.

In a preferred embodiment, the differentially-fed variable directivity slot antenna has two slot structures, wherein, a plane parallel to the dielectric substrate (101) is defined as an XY plane; a normal direction of the dielectric substrate (101) is defined as a Z axis direction; the XY plane includes an X axis and a Y axis which are orthogonal to each other; in each slot structure (601•605), the first selective radiation portion group includes a selective radiation portion (601*b*•605*b*) parallel to the X axis and a selective radiation portion (601*c*•605*c*) parallel to the Y axis; in each slot structure (601•605), the second selective radiation portion group includes a selective radiation portion (603*b*•607*b*) parallel to the X axis and a selective radiation portion (603*c*•607*c*) parallel to the Y axis; each high-frequency switch in the first slot structure (601) short-circuits the ground conductor (105) on both sides bridged by the high-frequency switch; and the open-end point (605*cop*) of the selective radiation portion (605*c*) which is included in the first selective radiation portion group in the second slot structure (605) and which is parallel to the Y axis and the open-end point (607*cop*) of the selective radiation portion (607*c*) which is included in the second selective radiation portion group in the second slot structure (605) and which is parallel to the Y axis are disposed so as to be apart by about ½ effective wavelength at the frequency fo, whereby, a radiation gain in a first direction connecting the first open-end point and the second open-end point is suppressed; a main beam is directed in a direction within a plane which is orthogonal to the first direction; and one of the two or more different radiation directivities is realized.

In a preferred embodiment, the differentially-fed variable directivity slot antenna has two slot structures, wherein, a plane parallel to the dielectric substrate (101) is defined as an XY plane; a normal direction of the dielectric substrate (101) is defined as a Z axis direction; the XY plane includes an X axis and a Y axis which are orthogonal to each other; in each slot structure (601•605), the first selective radiation portion group includes a selective radiation portion (601*b*•605*b*) parallel to the X axis and a selective radiation portion (601*c*•605*c*) parallel to the Y axis; in each slot structure (601•605), the second selective radiation portion group includes a selective radiation portion (603*b*•607*b*) parallel to the X axis and a selective radiation portion (603*c*•607*c*) parallel to the Y axis; each high-frequency switch in the second slot structure (605) short-circuits the ground conductor (105) on both sides bridged by the high-frequency switch; the open-end point (601*cop*) of the selective radiation portion (601*c*) which is included in the first selective radiation portion group in the first slot structure (601) and which is parallel to the Y axis and the open-end point (603*cop*) of the selective radiation portion (603*c*) which is included in the second selective radiation portion group in the first slot structure (601) and which is parallel to the Y axis are disposed so as to be apart by about ½ effective wavelength at the frequency fo, whereby, a radiation gain in a first direction connecting the first open-end point and the second open-end point is suppressed; a main beam is directed in a direction within a plane which is orthogonal to the first direction; and one of the two or more different radiation directivities is realized.

In a preferred embodiment, the differentially-fed variable directivity slot antenna has two slot structures, wherein, a plane parallel to the dielectric substrate (101) is defined as an XY plane; a normal direction of the dielectric substrate (101) is defined as a Z axis direction; the XY plane includes an X axis and a Y axis which are orthogonal to each other; in each slot structure (601•605), the first selective radiation portion group includes a selective radiation portion (601*b*•605*b*) parallel to the X axis and a selective radiation portion (601*c*•605*c*) parallel to the Y axis; in each slot structure (601•605), the second selective radiation portion group includes a selective radiation portion (603*b*•607*b*) parallel to the X axis and a selective radiation portion (603*c*•607*c*) parallel to the Y axis; each high-frequency switch in the second slot structure (605) short-circuits the ground conductor (105) on both sides bridged by the high-frequency switch; and the open-end point (601*bop*) of the selective radiation portion (601*b*) which is included in the first selective radiation portion group in the first slot structure (601) and which is parallel to the X axis and the open-end point (603*bop*) of the selective radiation portion (603*b*) which is included in the second selective radiation portion group in the first slot structure (601) and which is parallel to the X axis are disposed so as to be apart by about ½ effective wavelength at the frequency fo, whereby, a main beam is directed in a direction within a plane which is orthogonal to a first direction connecting the first open-end point and the second open-end point; and one of the two or more different radiation directivities is realized.

Thus, in accordance with a differentially-fed variable directivity slot antenna according to the present invention, firstly, efficient radiation is obtained in directions which are not available with conventional differentially-fed antennas. Secondly, the main beam direction is variable within a wide range of solid angles. Thirdly, gain suppression is realized in a direction that is different from the main beam direction.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 2A is a cross-sectional structural diagram taken along line A1-A2 in FIG. 1. FIG. 2B is a cross-sectional structural diagram taken along line B1-B2 in FIG. 1. FIG. 2C is a cross-sectional structural diagram taken along line C1-C2 in FIG. 1.

FIGS. 5A and 5B are schematic diagrams showing examples of reconfigurability of the slot structure 601 not in an operating state. FIG. 5A is a schematic diagram of the slot structure 601 in a non-operating state. FIG. 5B is a schematic diagram of the slot structure 601 in an undesirable state.

FIGS. 17A and 17B are structural diagrams of Conventional Example 1. FIG. 17A is an upper schematic see-through view. FIG. 17B is a cross-sectional structural diagram.

FIGS. 18A and 18B are radiation directivity characteristics diagrams of Conventional Example 1. FIG. 18A is a radiation directivity characteristics diagram in the YZ plane. FIG. 18B is a radiation directivity characteristics diagram in the XZ plane.

FIGS. 19A and 19B are structural diagrams of Conventional Example 2. FIG. 19A is an upper schematic see-through view. FIG. 19B is a cross-sectional structural diagram.

FIG. 20A is a radiation directivity characteristics diagram in the YZ plane. FIG. 20B is a radiation directivity characteristics diagram in the XZ plane.

FIG. 21A is a schematic diagram in the case of feeding through a single-ended feed line. FIG. 21B is a schematic diagram in the case of feeding through a differential feed line.

FIGS. 22A and 22B are structural diagrams of Conventional Example 4. FIG. 22A is a perspective schematic see-through view. FIG. 22B is an upper schematic view. FIG. 22C is a lower schematic view.

FIGS. 23A and 23B are radiation directivity characteristics diagrams of Conventional Example 4. FIG. 23A is a radiation directivity characteristics diagram in the YZ plane. FIG. 23B is a radiation directivity characteristics diagram in the XZ plane.

FIG. 24, which is FIG. 1 of Conventional Example 5, is a schematic structural diagram of a single-ended feed variable antenna.

DETAILED DESCRIPTION OF PREFERRED EMBODIMENTS

Hereinafter, an embodiment of the differentially-fed variable directivity slot antenna according to the present invention will be described. According to the present embodiment, it is possible to attain dynamic variability of radiation directivity for realizing efficient radiation in various directions, including directions in which conventional differentially-fed antennas cannot provide radiation. Furthermore, it is also possible to realize an industrially useful effect of suppressing the radiation gain in a direction which is different from the main beam direction.

Embodiment

Figure 1:
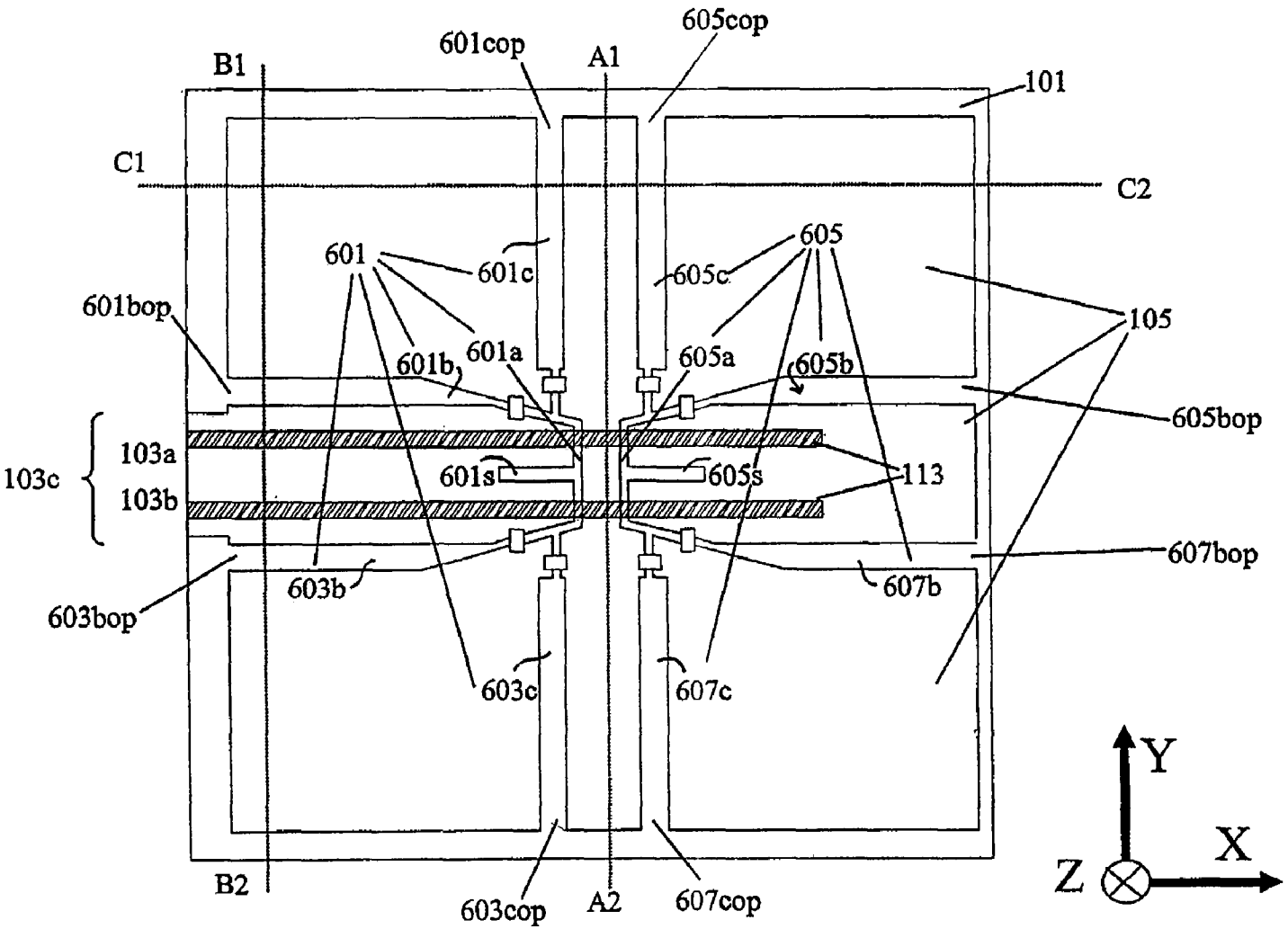
FIG. 1 is a schematic see-through view of an embodiment of the differentially-fed variable directivity slot antenna according to the present invention as seen from a rear face.
Figure 2A:
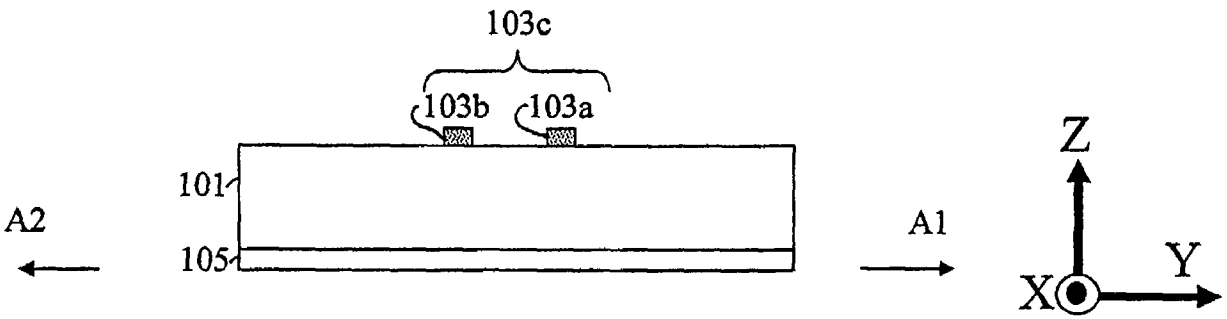
FIGS. 2A, 2B, and 2C are cross-sectional structural diagrams of the differentially-fed variable directivity slot antenna embodiment of FIG. 1.
Figure 2B:
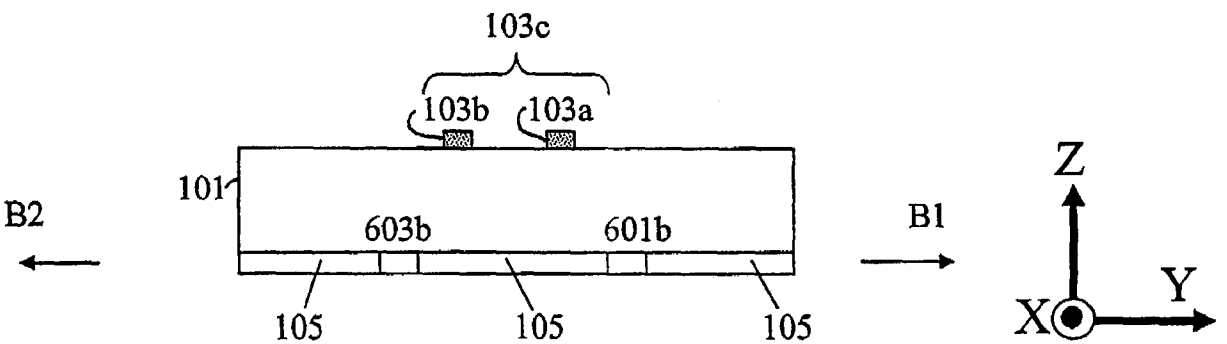
Figure 2C:
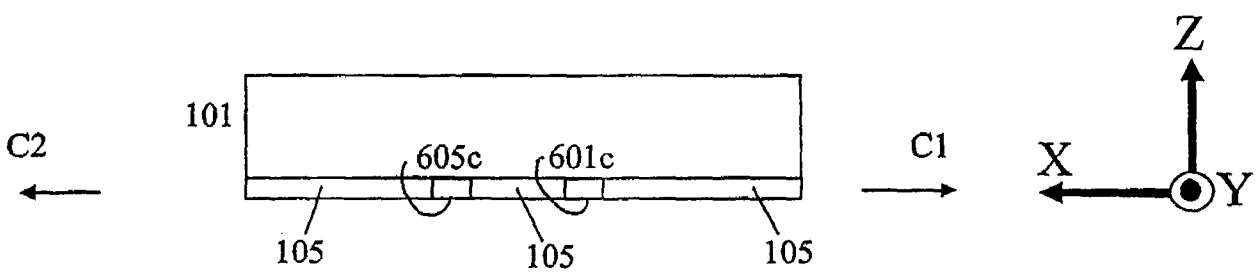

FIG. 1 is a structural diagram for illustrating an embodiment of the differentially-fed slot antenna according to the present invention, and provides a schematic see-through view as seen through a ground conductor on the rear face of a dielectric substrate. FIGS. 2A to 2C are cross-sectional structural diagrams of the circuit structure taken along line A1-A2, line B1-B2, and line C1-C2 in FIG. 1, respectively. The coordinate axes and signs in the figures correspond to the coordinate axes and signs in FIGS. 17A and 17B and FIGS. 22A to 22C showing constructions and radiation directions of Conventional Examples.

As shown in FIG. 1, a ground conductor 105 having a finite area is formed on the rear face of a dielectric substrate 101, and a differential feed line 103*c* is formed on the front face of the dielectric substrate 101. The differential feed line 103*c* is composed of a mirror symmetrical pair of signal conductors

103*a* and 103*b*. In partial regions of the ground conductor 105, the conductor is removed completely across the thickness direction to form slot circuits. Similarly, stubs 601*s* and 605*s* described later are also formed by completely removing the conductor across the thickness direction.

In an antenna according to the present invention, in response to an external control signal, at least one slot structure exhibits at least one of an RF structure reconfigurability function and an operation status switching function. In the embodiment shown in FIG. 1, two slot structures 601 and 605 are provided in the ground conductor 105. When set to be operating, the two slot structures 601 and 605 perform efficient radiation at an operating frequency fo. However, when set to be non-operating, the two slot structures 601 and 605 do not contribute to radiation. For example, in the slot structure 601, first selective radiation portions 601*b* and 601*c* are connected to one end of a feeding portion 601*a*, whereas second selective radiation portions 603*b* and 603*c* are connected to the other end of the feeding portion 601*a*. When set to be operating, in the slot structure 601, one first selective radiation portion and one second selective radiation portion are selected, such that the slot structure 601 has a slot length which equals a ½ effective wavelength at the operating frequency fo. In other words, when set to be operating, the slot structure 601 functions as a slot resonator with open both ends. The slot structure 605 is also capable of serving similar functions.

Figure 3:
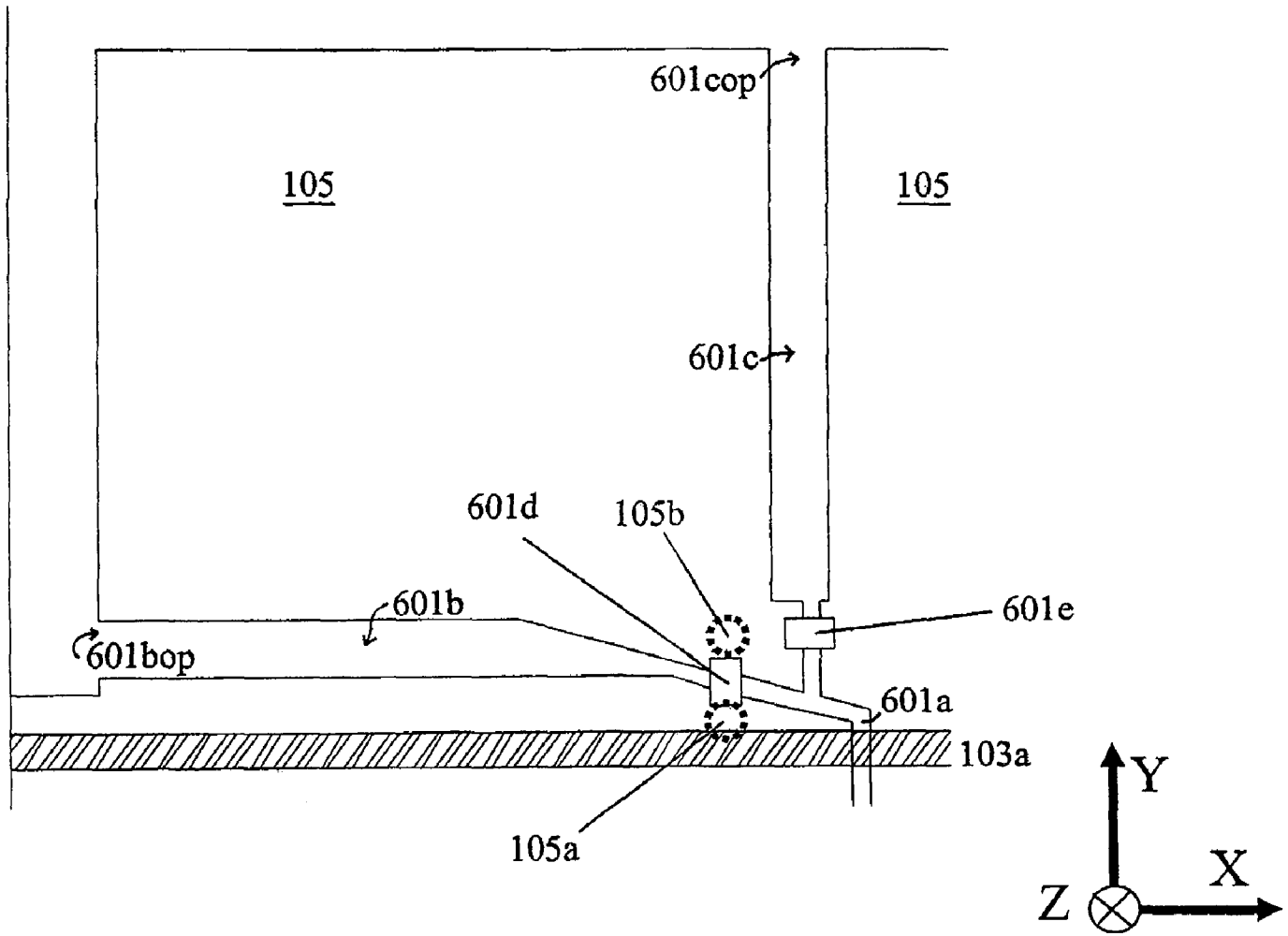
FIG. 3 is an enlarged view showing the neighboring structure of a slot structure 601.

FIG. 3 shows enlarged a local structure within the slot resonator 601 with open both ends. FIG. 3 shows a location where the feeding portion 601*a* is connected to the first selective radiation portions 601*b* and 601*c* in the slot structure 601. The second selective radiation portions 603*b* and 603*c* are omitted from illustration. In order to realize the reconfigurability and switching functions of the slot structure 601, the external control signal controls the states of a high-frequency switching element 601*d* which is disposed between the feeding portion 601*a* and the selective radiation portion 601*b*, and also controls a high-frequency switching element 601*e* which is disposed between the feeding portion 601*a* and the selective radiation portion 601*c*.

The high-frequency switches 601*d* and 601*e* may straddle a portion of the selective radiation portions 601*b* and 601*c*, respectively. Each selective radiation portion (601*b* and 601*c*) reaches an edge of the ground conductor 105 at its leading end opposite from the end at which it is connected to the feeding portion 601*a*, thus each being left open-ended at the open-end point (601*bop*, 601*cop*). For example, when the high-frequency switch 601*d* is controlled to be in a conducting state, electrical conduction is established between the ground conductor 105*a* and the ground conductor 105*b* which are split by the slots, whereby the selective radiation portion 601*b* and the feeding portion 601*a* become isolated in high-frequency terms. As a result, the open end 601*bop* no longer functions as an end point of the slot structure 601. Conversely, when the high-frequency switch 601*d* is controlled to be in an open state, high-frequency connection is restored between the selective radiation portion 601*b* and the feeding portion 601*a*. In this state, the open end 601*bop* functions as an end point of the slot structure. Thus, through control of the high-frequency switches, it is possible to change the high-frequency structure of the slot structure 601 appearing on the ground conductor 105.

Figure 4B:
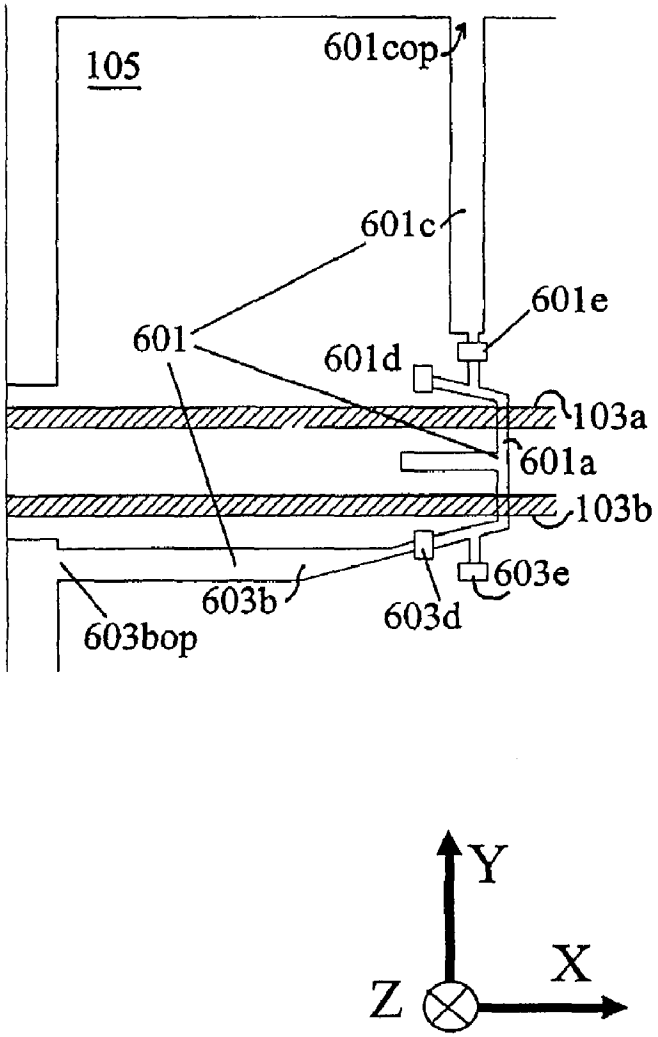
FIGS. 4A and 4B are schematic diagrams showing examples of reconfigurability of the slot structure 601 in an operating state.
Figure 4A:
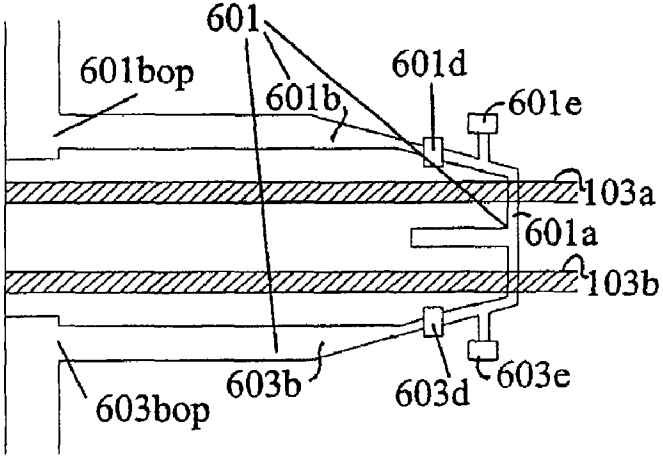

In each slot structure having an RF structure reconfigurability function, even while maintaining an operating state, the high-frequency structure of the slot structure changes in response to an external signal control, whereby different sets of radiation characteristics are provided. For example, while the slot structure 601 contributes to radiation operation, a state is to be always maintained where only one first selective radiation portion is connected to one end of the feeding portion 601*a* and only one second selective radiation portion is connected to the other end of the feeding portion 601*a*; yet, there is selectability as to each of the first selective radiation portion and the second selective radiation portion. FIGS. 4A and 4B show exemplary changes in high-frequency structure occurring when the slot structure of FIG. 3 is allowed to contribute to radiation operation. Note that FIGS. 4A and 4B assume a state where: the high-frequency switch 603*d* is open; the second selective radiation portion 603*b* is selected; the high-frequency switch 603*e* is conducting; and the second selective radiation portion 603*c* is unselected. Each unselected selective radiation portion is obscured. In FIG. 4A, the high-frequency switch 601*d* is open, whereas the high-frequency switch 601*e* is conducting. As a result, connection between the feeding portion 601*a* and the selective radiation portion 601*c* is terminated, so that the slot structure 601 now has a structure where the first selective radiation portion 601*b* and the second selective radiation portion 603*b* are connected, in series, to both ends of the feeding portion 601*a*. Both ends of the slot structure 601 are open points 601*bop* and 603*bop*, and the effective distance of the open points is a ½ effective wavelength. In other words, the slot structure 601 functions as a ½ effective wavelength slot resonator with open both ends. Conversely, as shown in FIG. 4B, when the high-frequency switch 601*d* is conducting and the high-frequency switch 601*e* is open, there emerges on the ground conductor 105 a ½ effective wavelength slot resonator with open both ends which is different from the structure shown in FIG. 4A.

On the other hand, as shown in FIG. 5, it is also possible to utilize the operation status switching function so as to control the slot structure 601 into a non-operating state for not contributing to radiation operation. The operation status switching function is a function to enable switching as to whether the slot structure is allowed to contribute to the radiation operation or not. In the example shown in FIG. 5A, all of the high-frequency switches 601*d*, 601*e*, 603*d*, and 603*e* are allowed to conduct, whereby all selective radiation portions are isolated from the feeding portion 601*a*. As a result, the slot structure 601 no longer contributes to radiation operation. For establishing an operating state, the high-frequency switches may be controlled as shown in FIGS. 4A and 4B. Table 1 summarizes relationship between: example manners of controlling the high-frequency switches; presence or absence of contribution of the slot structure 601 to radiation operation; selective radiation portions to be connected to the feeding portion 601*a*; and open-end points.

TABLE 1

| | | | | construction of slot resonator with open both ends | | |
|---|---|---|---|---|---|---|
| | operating/ non- | high-frequency switch | | first selective radiation | second selective radiation | open-end |
| FIG. | operating | 601d | 601e | portion | portion | point |
| 4A | operating | open | conducting | 601b | 603b | 601bop 603bop |
| 4B | operating | conducting | open | 601c | 603b | 601cop 603bop |
| 5A | non-operating | conducting | conducting | — | — | — |

Note that, as shown in FIG. 5B, an undesirable state is where only one selective radiation portion is selected to be connected to the feeding portion in any slot structure, because it may result in unwanted reflection of an in-phase signal. In order to set a slot structure in a non-operating state, it is preferable to isolate all selective radiation portions from the feeding portion, as shown in FIG. 5A.

A total of the effective electrical lengths of the feeding portion and the selective radiation portions is prescribed so that the slot length of every slot resonator that is in an operating state always equals a ½ effective wavelength. It is preferable that the feeding portions are set in a mirror symmetrical structure with respect to the plane of mirror symmetry between the two signal conductors 103*a* and 103*b*. At places near the plane of mirror symmetry, stubs 601*s* and 605*s* are connected to the feeding portions 601*a* and 605*a*, respectively.

Figure 11A:
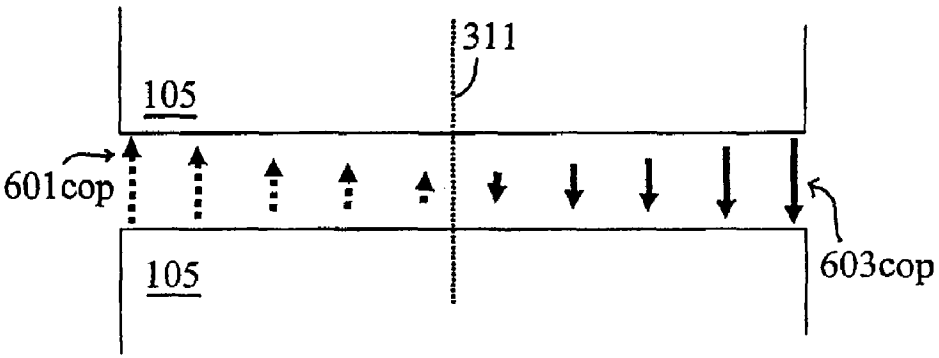
FIG. 11A is a schematic diagram showing electric field vectors occurring within a ½ effective wavelength slot resonator with open both ends when undergoing out-of-phase excitation at the center.
Figure 11B:
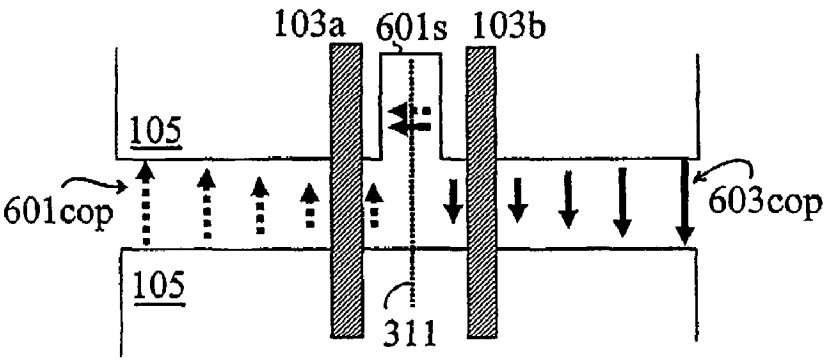
FIG. 11B is a schematic diagram showing a relationship between a ½ effective wavelength slot resonator with open both ends and a differential feed line in a differentially-fed variable directivity slot antenna according to the present invention.

FIG. 11A schematically shows an electric field vector distribution in the case where a ½ effective wavelength slot resonator with open both ends having the open-end points 601*cop* and 603*cop* is fed with out-of-phase equal-amplitude power. In a plane of mirror symmetry 311 along the slot length direction, a node (where electric field vectors cancel out one another) occurs which makes it impossible to efficiently excite the slot resonator near the plane of mirror symmetry. Furthermore, in order to avoid increase in characteristic impedance in the differential transmission mode, it is impossible to set a large gap width between the first and second signal conductors. Therefore, as shown in FIG. 11B, the slot structure of the present invention relies on the stubs 601*s* and 605*s* to achieve good coupling with the differential transmission line. However, in the stub region, out of phase signals which are fed from the signal conductors 103*a* and 103*b* mutually enhance the electric fields.

As described later, in the differentially-fed variable directivity antenna according to the present invention, each slot resonator with open both ends changes its radiation characteristics through a control concerning which selective radiation portions are to be selected from among the plurality of selective radiation portions. However, irrespective of the above control, electromagnetic waves will always be emitted from the stubs in an operating state. Therefore, the ability to change directivities based on operation status switching will be lost unless it is ensured that the radiation intensity from the selective radiation portions is stronger than the radiation intensity from the stubs.

From the above standpoint, the length of each of the stubs 601*s* and 605*s* is set to less than a ⅛ effective wavelength at the operating frequency fo. Moreover, in order to avoid an unintended mode conversion of the input or output differential signal into an unwanted in-phase mode signal, it is preferable to shape and position the stubs so as to be mirror-symmetrical with respect to the same plane of symmetry as the plane of symmetry of the differential feed line. Moreover, the stubs do not intersect the outer borders of the signal conductors 103*a* and 103*b*. In order to prevent contribution to radiation operation in a non-operating state, the electrical length of each of the feeding portions 601*a* and 605*a* is less than a ¼ effective wavelength at the operating frequency fo.

According to principles, a slot resonator with open both ends is equivalent, during operation, to a pair of slot resonators with one open end which are fed out-of-phase and with an equal amplitude so as to operate in pair. Therefore, each slot resonator during operation is set so that an equal intensity of power is fed from the two signal conductors 103*a* and 103*b*. In order to satisfy this condition, any first selective radiation portion and any second selective radiation portion that operate in pair during operation are positioned so as to be physically mirror symmetrical with respect to the plane of mirror symmetry of the differential transmission line 103*c*. Moreover, a similar effect can also be realized by prescribing symmetrical high-frequency characteristics for each pair of a first selective radiation portion and a second selective radiation portion. In other words, the selective radiation portions operating in pair have the same effective length and the same characteristic impedance.

Hereinafter, a method for controlling the slot structures for realizing a radiation directivity which is very useful in practical use according to an embodiment of the present invention will be described.

Figure 6B:
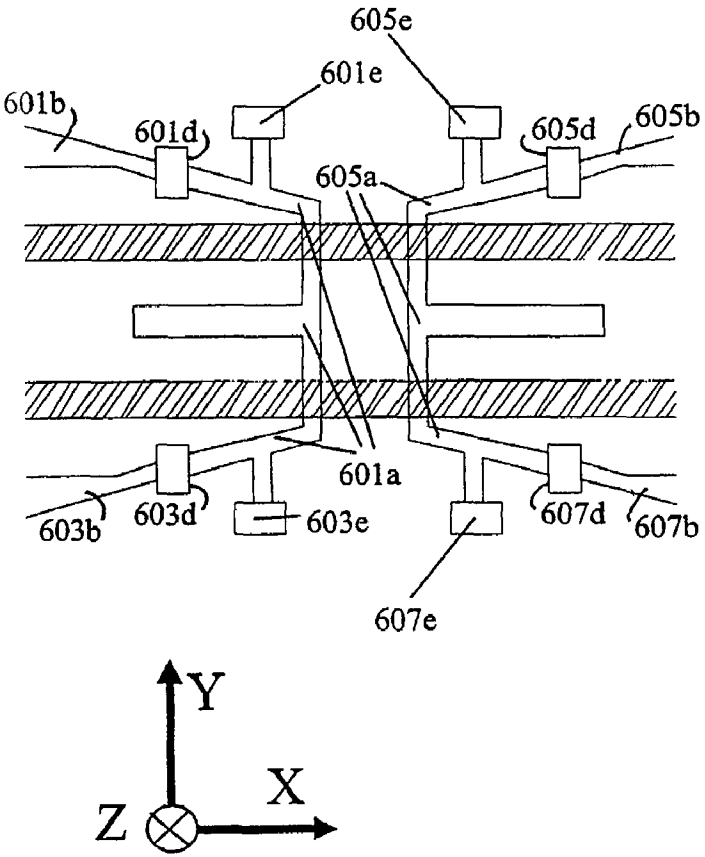
FIGS. 6A and 6B are structural diagrams of a differentially-fed variable directivity slot antenna according to the present invention in a first control state.
Figure 6A:
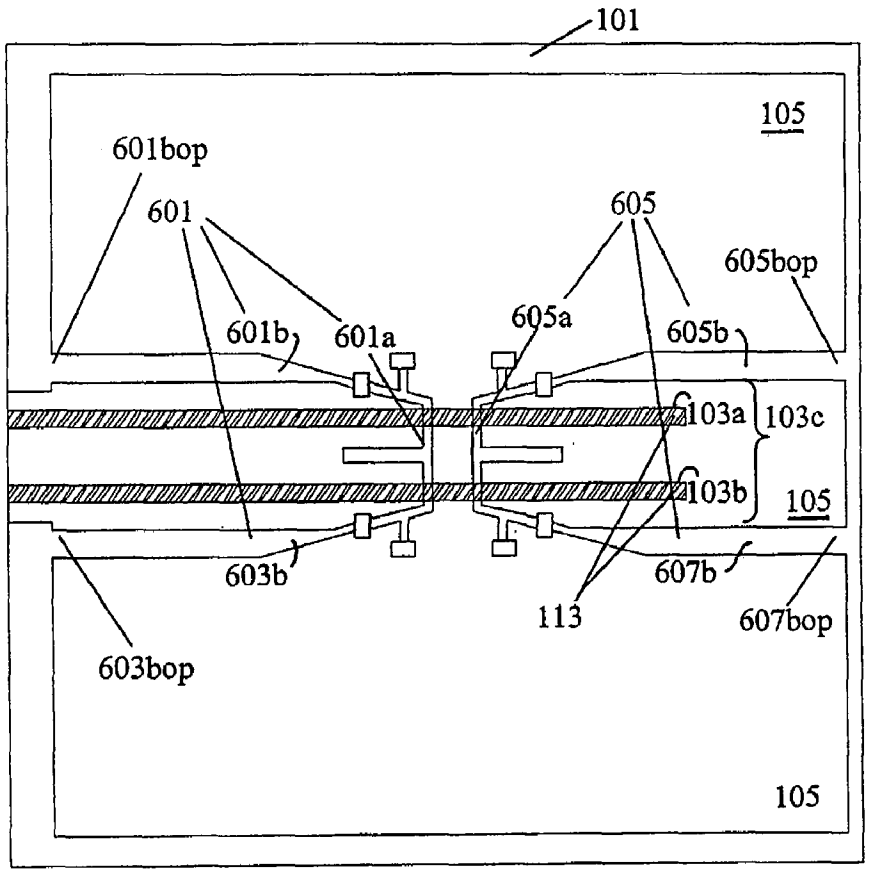

First, in a first control state, the differentially-fed variable directivity slot antenna with the construction shown in FIG. 1 creates a high-frequency structure as shown in FIG. 6 by utilizing the RF structure reconfigurability function of the two slot structures. The slot structures 601 and 605 are controlled so that the selective radiation portions 601*b*, 603*b*, 605*b*, and 607*b* are selected while leaving the selective radiation portions 601*c*, 603*c*, 605*c*, and 607*c* unselected. The unselected selective radiation portions are not shown in the figure. Through the above control, the two slot structures 601 and 605 each form a ½ effective wavelength slot resonator with open both ends. In the first control state, the differentially-fed variable directivity slot antenna of the present embodiment provides an efficient radiation such that the main beam direction is oriented substantially symmetrical in the ±Y direction. Moreover, radiation into the XZ plane is forcibly suppressed. In other words, interference waves coming in any arbitrary direction within a plane that is orthogonal to the main beam direction can be efficiently suppressed.

In the differentially-fed variable directivity antenna according to the present invention, signals which are of an equal amplitude and out of phase are input from the differential feed line. Therefore, a condition for allowing electric fields to cancel out each other in the far field is established across a wide range. In the antenna of Conventional Example 5 which realizes directivity switching by single-ended feeding, there is no signal which is of an equal amplitude and out of phase to cancel out the single-end signal that is being fed, so that a condition for obtaining a high gain suppression is not established, or if at all such is established, it will merely result in characteristics with a very limited angle range and low gain suppression. That is, only with the construction of the present invention can the effects of main beam direction control and gain suppression be simultaneously obtained.

In the first control state, the distance between the open-end point 601*bop* and the open-end point 603*bop* of the first slot structure 601 is set to less than a ¼ effective wavelength at the operating frequency. Moreover, the distance between the open-end point 605*bop* and the open-end point 607*bop* of the slot structure 603 is also set to less than a ¼ effective wavelength at the operating frequency. Furthermore, the distance between the open-end point 601*bop* and the open-end point 605*bop* and the distance between the open-end point 603*bop* and the open-end point 607*bop* are each set to about ½ effective wavelength at the operating frequency. The contributions from two open-end points which are apart by a distance less than a ¼ effective wavelength to the radiation into the far field can be regarded as being in phase, with little phase difference associated with the positioning distance. On the other hand, the contributions from two open-end points which are apart by a distance of about ½ effective wavelength to the radiation into the far field can be regarded as being out of phase, because of a large phase difference associated with the positioning distance. From this relationship as well as the fact that the slot resonators in a pair structure are fed out-of-phase, it is possible to logically understand the relationship between the directions in which radiations enhance each other and the directions in which radiations cancel each other in the first control state.

Figure 7B:
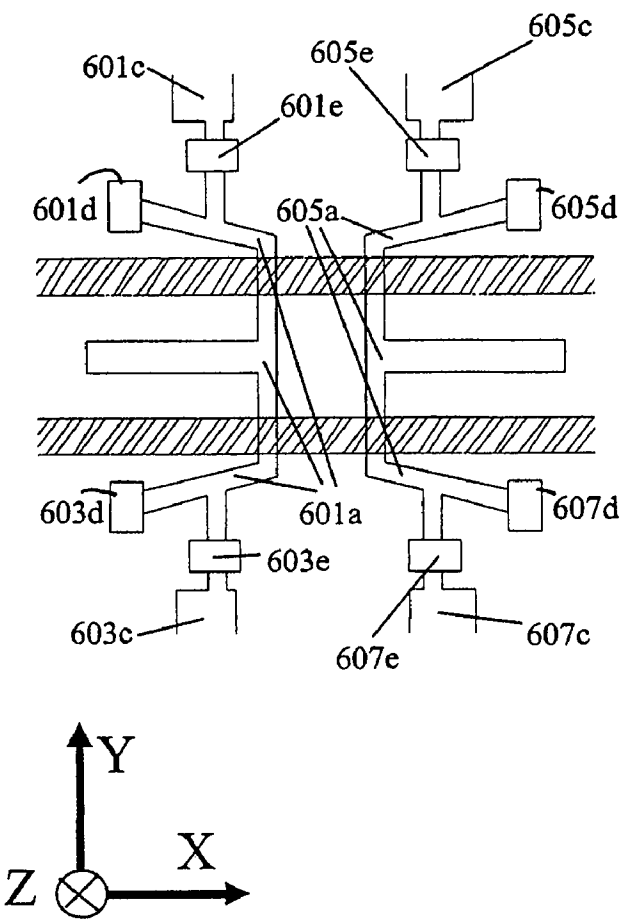
FIGS. 7A and 7B are structural diagrams of a differentially-fed variable directivity slot antenna according to the present invention in a second control state.
Figure 7A:
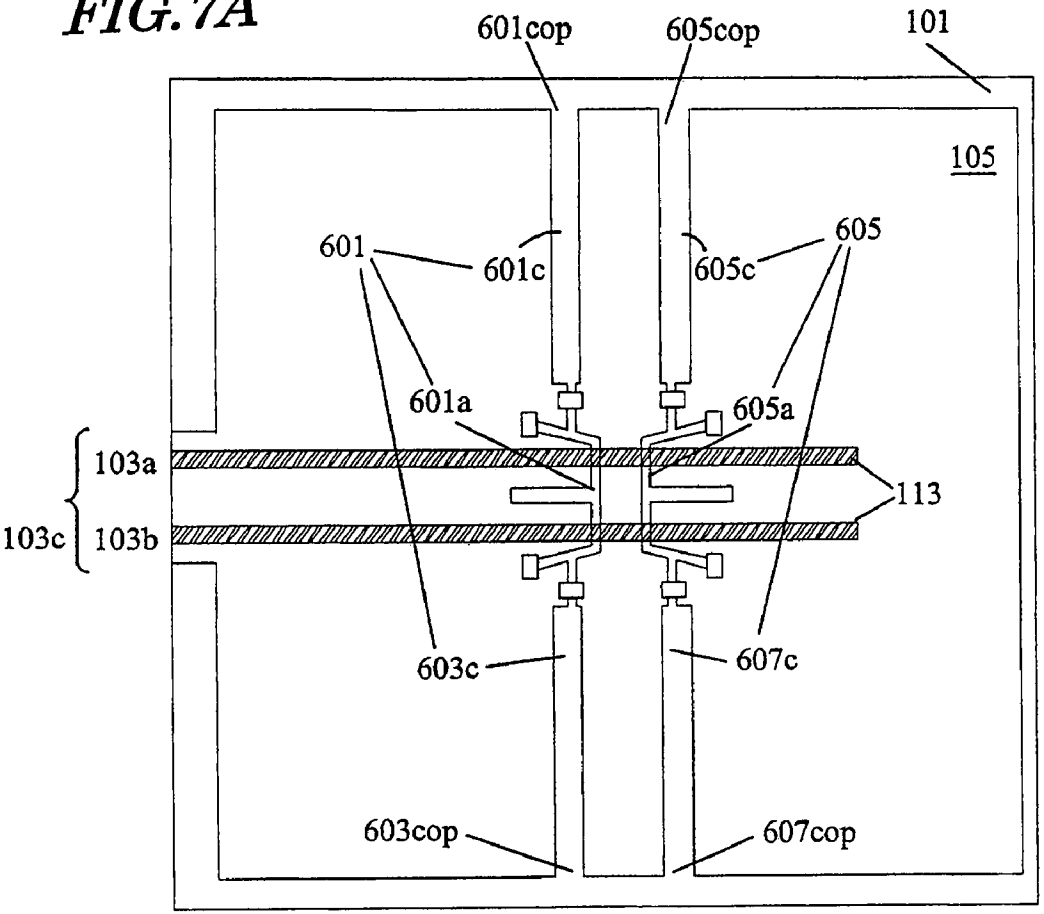

Next, in a second control state, the differentially-fed variable directivity slot antenna with the construction shown in FIG. 1 creates a high-frequency structure as shown in FIG. 7 by utilizing the RF structure reconfigurability function of the two slot structures. The slot structures 601 and 605 are placed in an operating state, in such a manner that the selective radiation portions 601*c*, 603*c*, 605*c*, and 607*c* are selected while leaving the selective radiation portions 601*b*, 603*b*, 605*b*, and 607*b* unselected. The unselected selective radiation portions are not shown in the figure. Through the above control, the two slot structures 601 and 605 each form a ½ effective wavelength slot resonator with open both ends. In the second control state, the differentially-fed variable directivity slot antenna of the present embodiment provides an efficient radiation such that the main beam direction is oriented substantially symmetrical in the ±X direction. Moreover, radiation into the YZ plane is forcibly suppressed. In other words, also in the second control state, interference waves coming in any arbitrary direction within a plane that is orthogonal to the main beam direction can be efficiently suppressed. Furthermore, the respective main beam directions in the first control state and the second control state are completely orthogonal, and thus a wide solid angle range can be covered with a single antenna.

In the second control state, the distance between the open-end point 601*cop* and the open-end point 603*cop* of the slot structure 601 and the distance between the open-end point 605*cop* and the open-end point 607*cop* of the slot structure 605 are each set to about ½ effective wavelength at the operating frequency fo. Moreover, the distance between the open-end point 601*cop* and the open-end point 605*cop* and the distance between the open-end point 603*cop* and the open-end point 607*cop* are each set to less than a ¼ effective wavelength at the operating frequency.

Figure 8B:
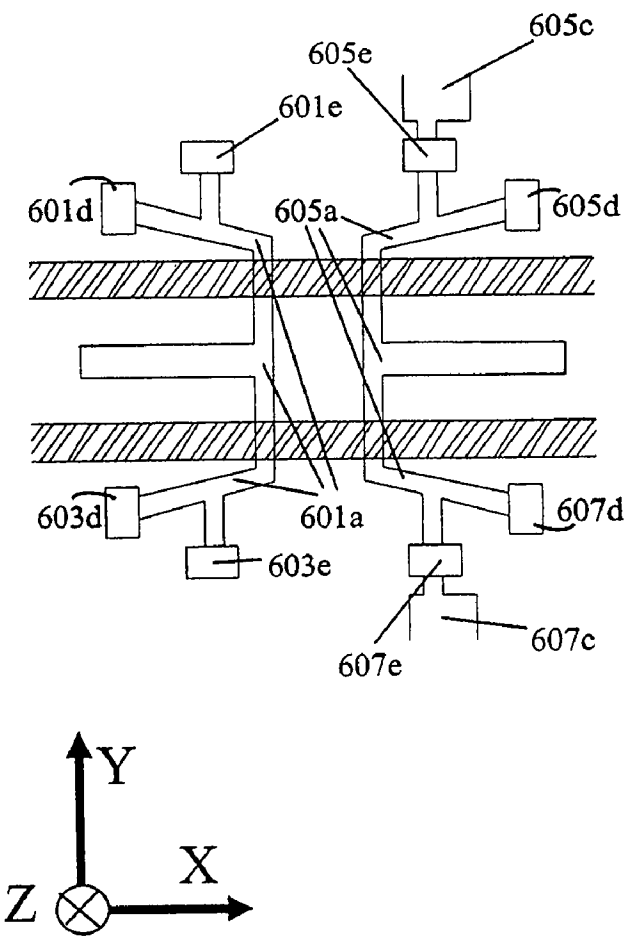
FIGS. 8A and 8B are structural diagrams of a differentially-fed variable directivity slot antenna according to the present invention in a third control state.
Figure 8A:
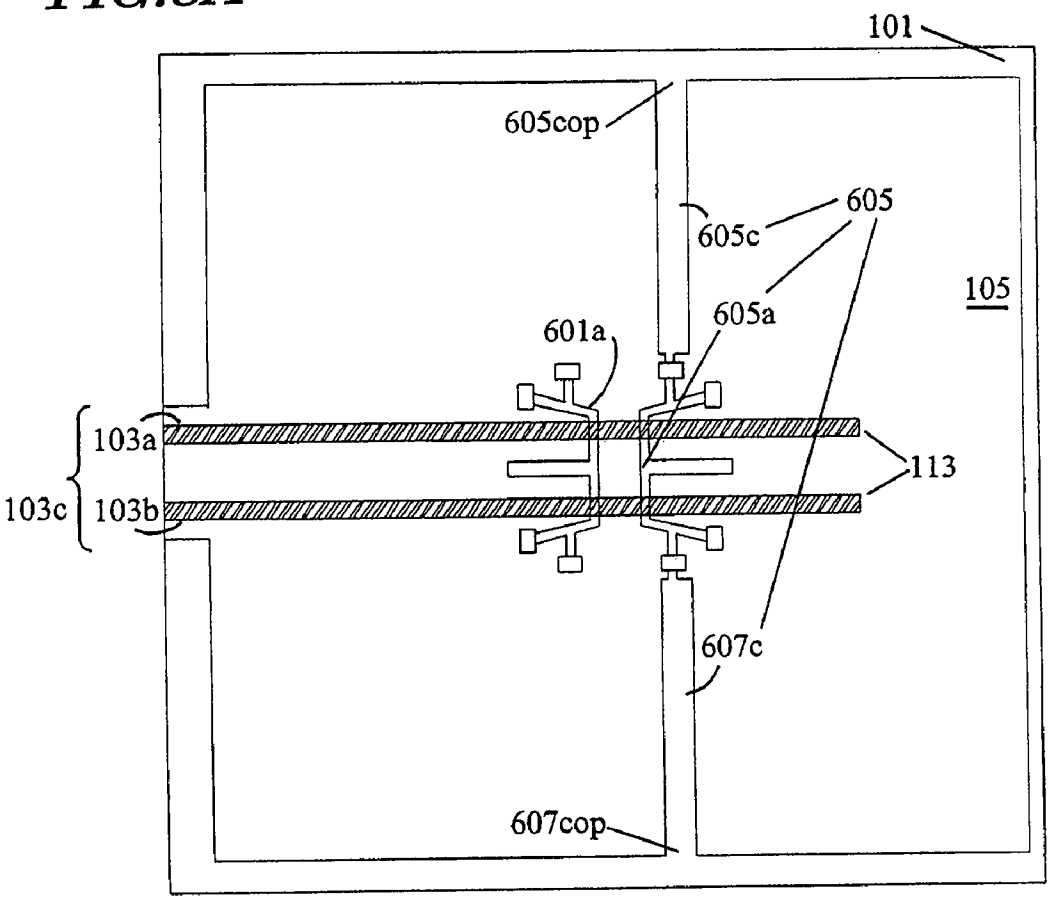

Next, in a third control state, the differentially-fed variable directivity slot antenna with the construction shown in FIG. 1 creates a high-frequency structure as shown in FIG. 8 by utilizing the RF structure reconfigurability function and the operation status switching function of the two slot structures 601 and 605. Specifically, the slot structure 601 is controlled to be in a non-operating state, and the selective radiation portion 605*c* and the selective radiation portion 607*c* in the slot structure 605 are selected. The unselected selective radiation portions are not shown in the figure.

In this third control state, the differentially-fed variable directivity antenna according to the present invention has radiation characteristics such that the main beam direction is broadly distributed in the XZ plane but slightly inclined in the −X direction, while radiation in the ±Y direction is forcibly suppressed. In a manner of encompassing all solid angles, this set of radiation characteristics is complementary to the set of radiation characteristics of the first control state, where radiation within the XZ plane is suppressed while only allowing radiation in the ±Y direction. This illustrates the high usefulness of the differentially-fed variable directivity antenna according to the present invention of being able to simultaneously provide both radiation states with a single piece of hardware. In the third control state, the distance between the open-end point 605*cop* and the open-end point 607*cop* is set to about ½ effective wavelength at the operating frequency fo.

Figure 9B:
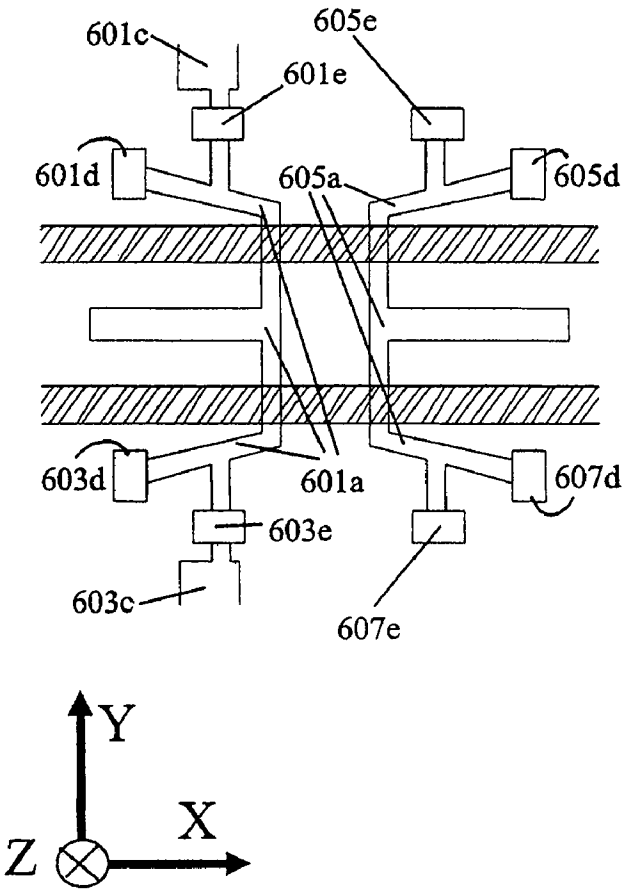
FIGS. 9A and 9B are structural diagrams of a differentially-fed variable directivity slot antenna according to the present invention in a fourth control state.
Figure 9A:
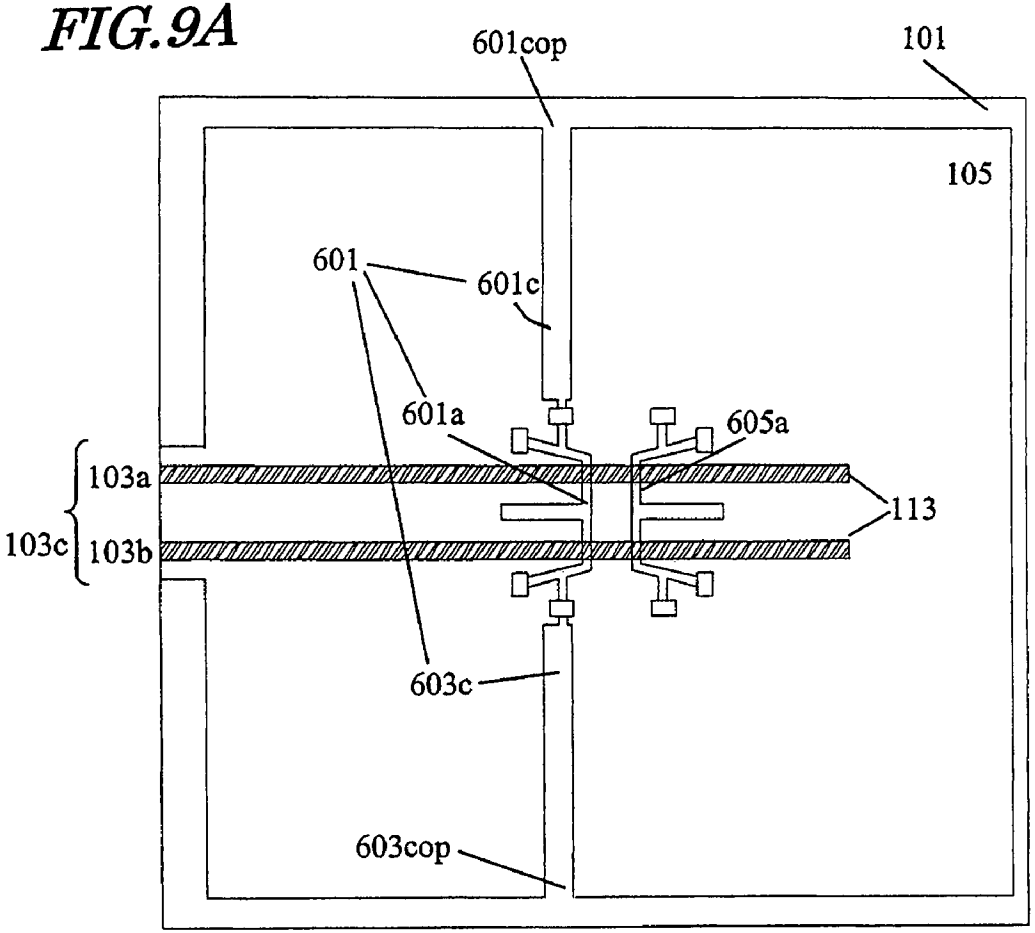

Next, in a fourth control state, the differentially-fed variable directivity slot antenna with the construction shown in FIG. 1 creates a high-frequency structure as shown in FIG. 9 by utilizing the RF structure reconfigurability function and the operation status switching function of the two slot structures 601 and 605. Specifically, the slot structure 605 is controlled to be in a non-operating state, and the selective radiation portion 601*c* and the selective radiation portion 603*c* in the slot structure 601 are selected. The unselected selective radiation portions are not shown in the figure. Similarly to the third control state, the fourth control state attains radiation characteristics such that the main beam direction is broadly distributed in the XZ plane, while radiation in the ±Y direction is forcibly suppressed. In other words, the fourth control state also attains a set of radiation characteristics that is complementary to the set of radiation characteristics of the first control state in a manner of encompassing all solid angles, although a difference in high-frequency structure from the third control state appears in a tilt of the main beam direction. Specifically, unlike in the third control state, the fourth control state provides radiation characteristics such that the main beam direction is slightly oriented in the +X direction.

Thus, with the differentially-fed variable directivity slot antenna according to the present invention, not only is it possible to obtain efficient radiation in the ±Y direction (in which it has conventionally been difficult to attain efficient radiation by differential feeding), but it is also possible to realize a directivity switching function in a wide range of solid angles. Furthermore, in each control state, it is possible to obtain a gain suppression effect according to natural principles in directions which would be the main beam directions in other control states.

Figure 10B:
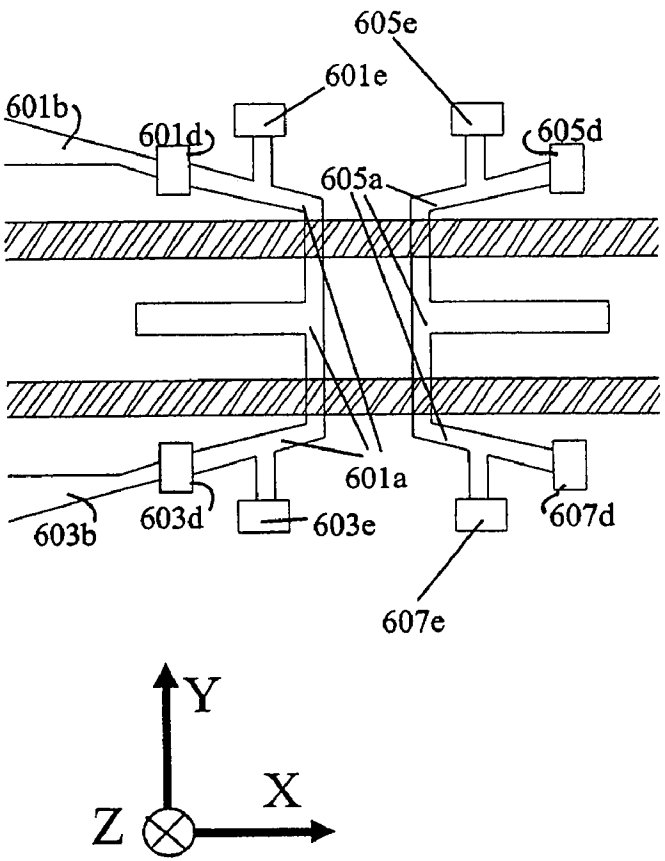
FIGS. 10A and 10B are structural diagrams of a differentially-fed variable directivity slot antenna according to the present invention in a fifth control state.
Figure 10A:
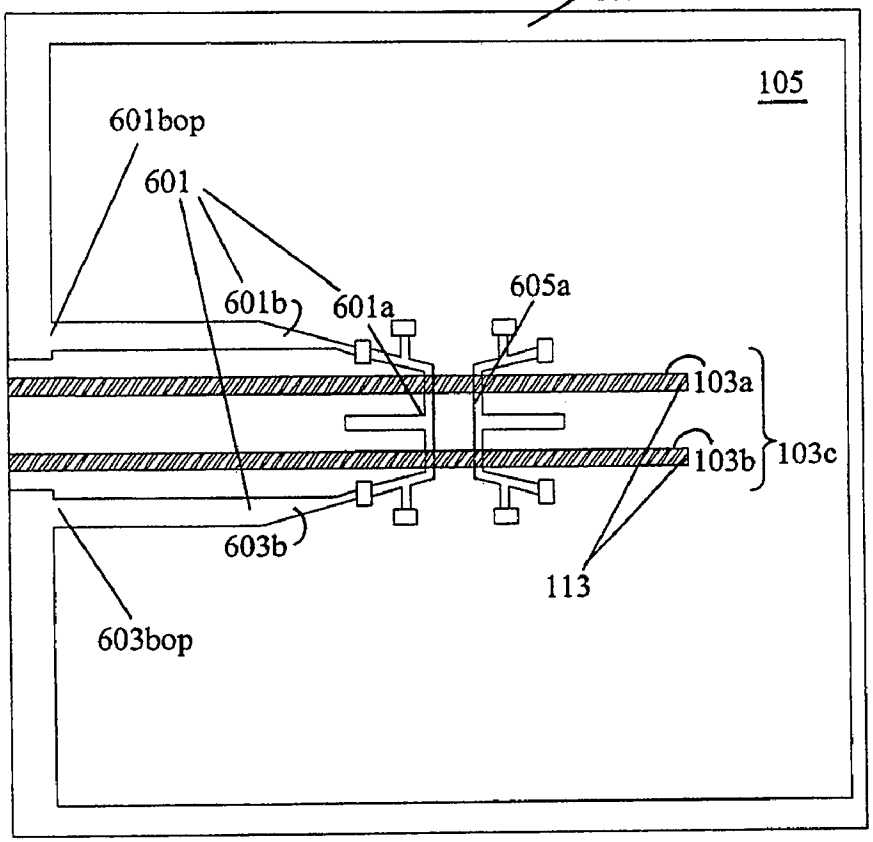

Moreover, in a fifth control state, the differentially-fed variable directivity slot antenna with the construction shown in FIG. 1 creates a high-frequency structure as shown in FIG. 10 by utilizing the RF structure reconfigurability function and the operation status switching function of the two slot structures 601 and 605. Specifically, the slot structure 605 is controlled to be in a non-operating state, and the selective radiation portion 601*b* and the selective radiation portion 603*b* in the slot structure 601 are selected. The unselected selective radiation portions are not shown in the figure. Also in this fifth control state, it is possible to allow the main beam direction to be broadly distributed in the XZ plane. Moreover, in this control state, the degree of gain suppression on the radiation from the ±Y direction relative to the main beam is less than 10 dB, thus making it possible to provide radiation characteristics which are optimum for applications where strong gain suppression is not desired. In other words, the differentially-fed variable directivity slot antenna according to the present invention not only realizes the radiation characteristics with strong immunity against interference waves as illustrated in the first to fourth control states, but also realizes radiation characteristics which are optimum for the purpose of waiting on a desired wave that may possibility arrive in a wide range of solid angles. Table 2 summarizes changes in the slot structure and the realized radiation characteristics in the first to fifth control states.

TABLE 2

| control state | FIG. | slot structure: slot structure in operating state | slot structure: selected selective radiation portion | slot structure: open-end point | main beam direction | gain suppression |
|---|---|---|---|---|---|---|
| first | 6A<br>6B | first<br>(601)<br>second<br>(605) | 601b, 603b<br>605b, 607b | 601bop<br>603bop<br>605bop<br>607bop | ±Y<br>direction | XZ plane |
| second | 7A<br>7B | first<br>(601)<br>second<br>(605) | 601c, 603c<br>605c, 607c | 601cop<br>603cop<br>605cop<br>607cop | ±X<br>direction | YZ plane |
| third | 8A<br>8B | second<br>(605) | 605c, 607c | 605cop<br>607cop | XZ plane<br>(−X) | ±Y<br>direction |
| fourth | 9A<br>9B | first<br>(601) | 601c, 603c | 601cop<br>603cop | XZ plane<br>(+X) | ±Y<br>direction |
| fifth | 10A<br>10B | first<br>(601) | 601b, 603b | 601bop<br>603bop | XZ plane | — |

Note that the differential feed line 103*c* may be left open-ended at an end point 113. In order to improve the input matching characteristics for the slot resonators, the feed matching length from the end point 113 to each feeding portion (601*a*, 605*a*) is set so as to be a ¼ effective wavelength with respect to the differential transmission mode propagation characteristics in the differential line at the operating frequency fo. At the end point 113, the first signal conductor 103*a* and the second signal conductor 103*b* may be grounded via resistors of an equal value. At the end point 113, the first signal conductor 103*a* and the second signal conductor 103*b* may be connected to each other via a resistor. If a resistor(s) is introduced at the end point of the differential feed line, some of the input power to the antenna circuit will be consumed in the introduced resistor(s), and thus a decrease in radiation efficiency will result. However, such a resistor(s) will allow the input matching condition for the slot resonators to be relaxed, thus making it possible to reduce the value of feed matching length.

Specific examples of the high-frequency switches 601*d*, 601*e*, 603*d*, 603*e*, 605*d*, 605*e*, 607*d*, and 607*e* may be diode switches, high-frequency switches, MEMS switches or the like are available. For example, by using currently commercially-available diode switches as high-frequency switches, good switching characteristics with a series resistance value of 5Ω in a conducting state and a parasitic series capacitance value of about 0.05 pF in an open state can be easily obtained in a frequency band of 20 GHz or less, for example.

As described above, by adopting the structure of the present invention, it becomes possible to direct the main beam in a direction which cannot be achieved with a conventional slot antenna or differentially-fed antenna, switch the main beam direction in a wide solid angle range, and suppress the radiation gain mainly in directions which are orthogonal to the main beam direction. Thus, the present invention makes it possible to provide a variable directivity antenna such that all solid angles are encompassed in a complementary manner.

EXAMPLES

On an FR4 substrate measuring 30 mm along the X axis direction, 32 mm along the Y axis direction, and 1 mm along the Z axis direction, a differentially-fed variable directivity slot antenna according to the present invention as shown in FIG. 1 was fabricated. On the substrate surface, a differential feed line 103*c* having a line width of 1.3 mm and a line-to-line gap of 1 mm was formed. From a ground conductor 105 formed on the entire substrate rear face, the conductor was removed in partial regions by wet etching, thus realizing a slot structure. The conductor was a piece of copper having a thickness of 35 microns. The two slot structures 601 and 605 were all made identical in shape, and placed so as to be mirror symmetrical.

The plane of mirror symmetry was defined as X=0. The slot structures 601 and 605 each had a mirror symmetrical structure with respect to the plane of mirror symmetry (Y=0) of the differential feed line 103*c*. The differential signal line 103*c* was left open-ended at X=14.5. The slot width was 0.5 mm at places illustrated as being thin in the figure and 1 mm at places illustrated as being thick in the figure. The closest distance between the feeding portions 601*a* and 605*a* was 1.5 mm, and the stubs 601*s* and 605*s* of the feeding portions 601*a* and 605*a* each had an electrical length of 7.5 mm. A commercially available PIN diode was used as each high-frequency switch. Each switch operated with a DC resistance of 4Ω in a conducting state, and functioned as a 30 fF DC capacitance in an open state. Through controlling of the high-frequency switches, operation was obtained in five control states. At 2.52 GHz, each state realized return intensity characteristics such that a sufficiently low value of less than −10 dB was obtained in response to a differential signal input. Hereinafter, radiation characteristics obtained in each control state will be described. Note that, in each control state, there was only less than −30 dB of an in-phase mode signal return intensity in response to a differential signal input.

First Example

Figure 12C:
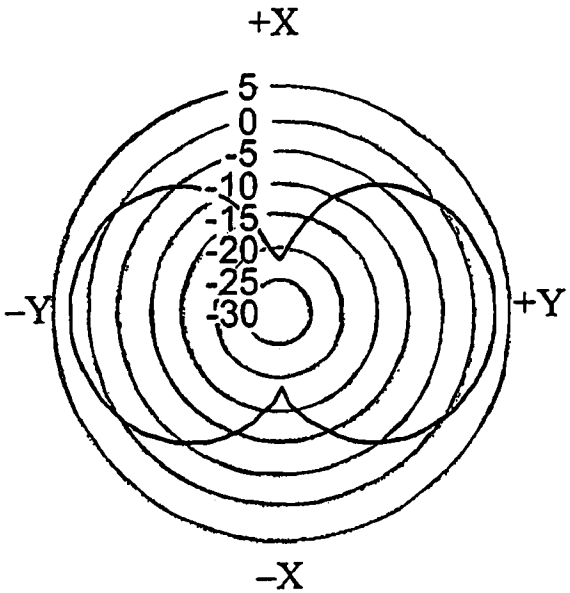
FIGS. 12A to 12C are radiation directivity diagrams of a First Example of the present invention.
Figure 12B:
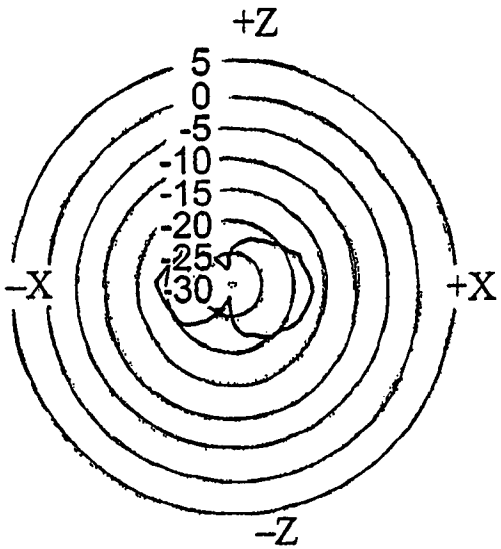
Figure 12A:
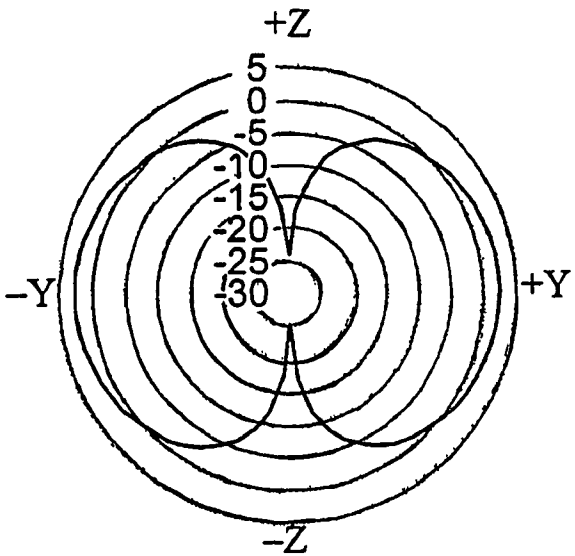

In the First Example, the high-frequency switches of each slot structure were controlled so as to realize the first control state shown in FIG. 6. A radiation directivity on each coordinate plane in this Example is shown in FIG. 12. As is clear from FIG. 12, it was proven that the first control state realizes radiation characteristics such that a main beam direction is oriented in the ±Y direction. In the Z axis direction, a gain suppression effect exceeding 25 dB was obtained relative to the gain in the main beam direction. In the X axis direction, too, a gain suppression effect of almost 20 dB was obtained relative to the gain in the main beam direction.

Second Example

Figures 13A, 13B, 13C:
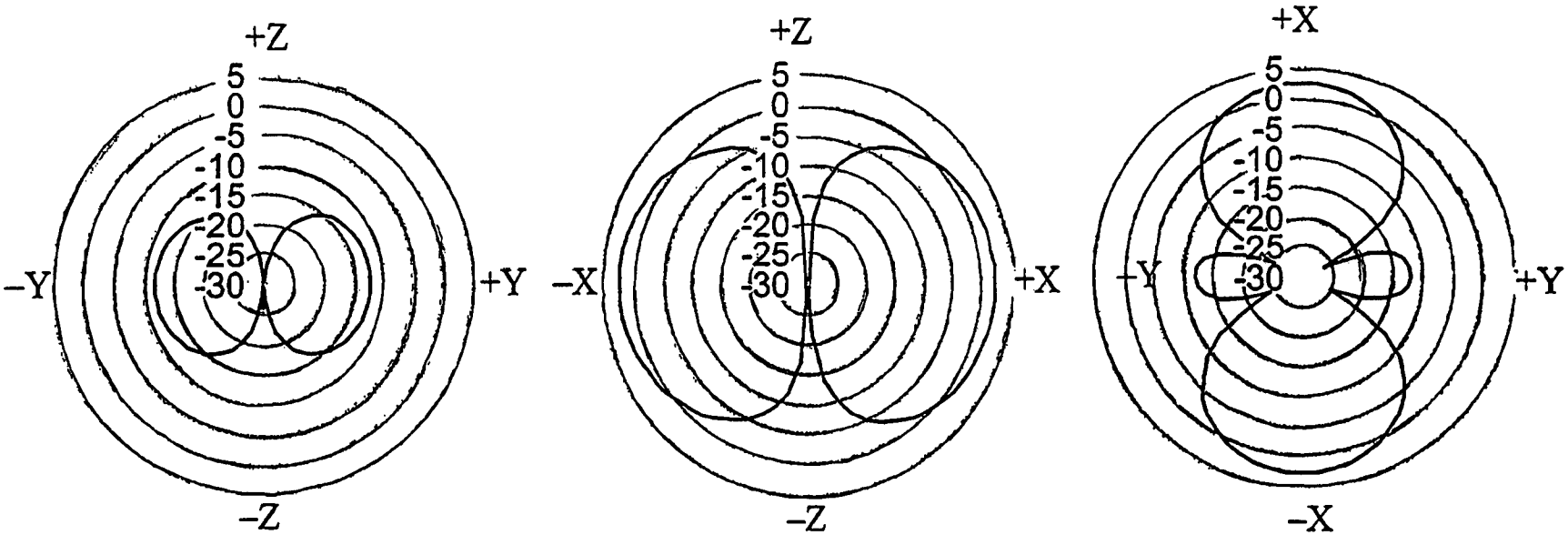
FIGS. 13A to 13C are radiation directivity diagrams of a Second Example of the present invention.

In the Second Example, the high-frequency switches of each slot structure were controlled so as to realize the second control state shown in FIG. 7. A radiation directivity on each coordinate plane in this Example is shown in FIG. 13. As is clear from FIG. 13, it was proven that the second control state realizes radiation characteristics such that a main beam direction is oriented in the ±X direction. In the Z axis direction, a gain suppression effect exceeding 30 dB was obtained relative to the gain in the main beam direction. In the Y axis direction, too, a strong gain suppression effect exceeding 15 dB was obtained relative to the gain in the main beam direction.

Third Example

Figure 14C:
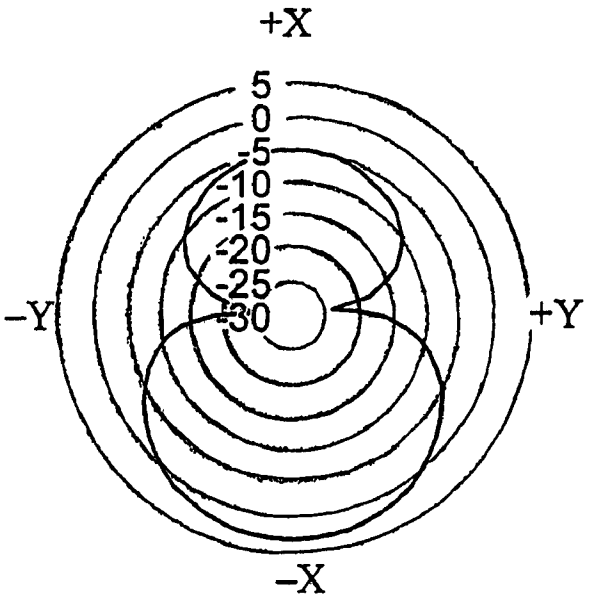
FIGS. 14A to 14C are radiation directivity diagram of a Third Example of the present invention.
Figure 14B:
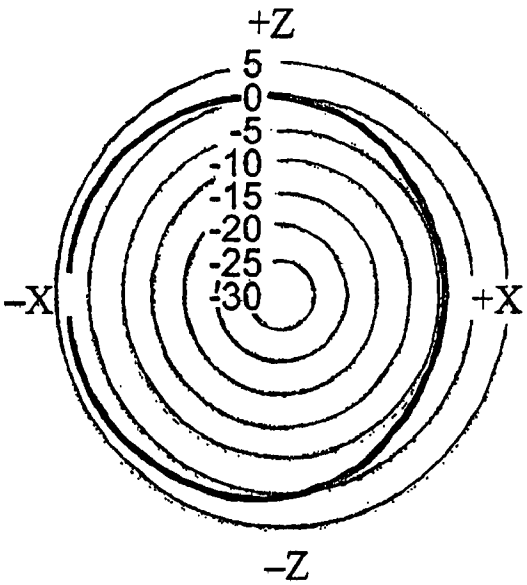
Figure 14A:
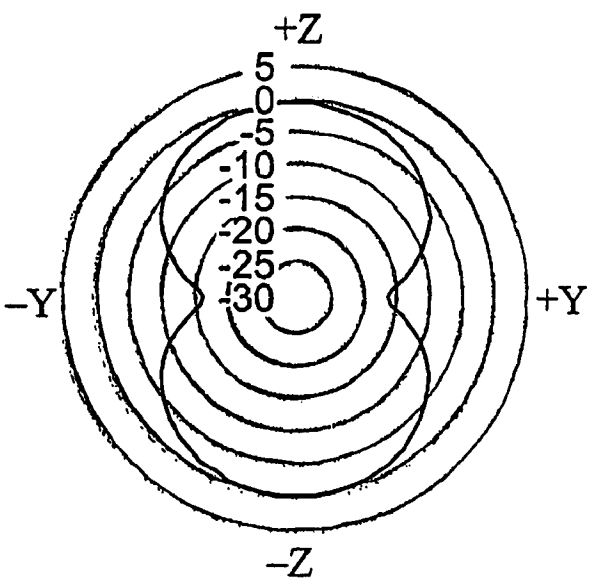

In the Third Example, the high-frequency switches of each slot structure were controlled so as to realize the third control state shown in FIG. 8. A radiation directivity on each coordinate plane in this Example is shown in FIG. 14. As is clear from FIG. 14, it was proven that the third control state realizes a radiation which is distributed in the XZ plane, in particular radiation characteristics such that a main beam direction being oriented in the −X direction. In the Y axis direction, a strong gain suppression effect exceeding 25 dB was obtained relative to the gain in the main beam direction.

Fourth Example

Figures 15A, 15B, 15C:
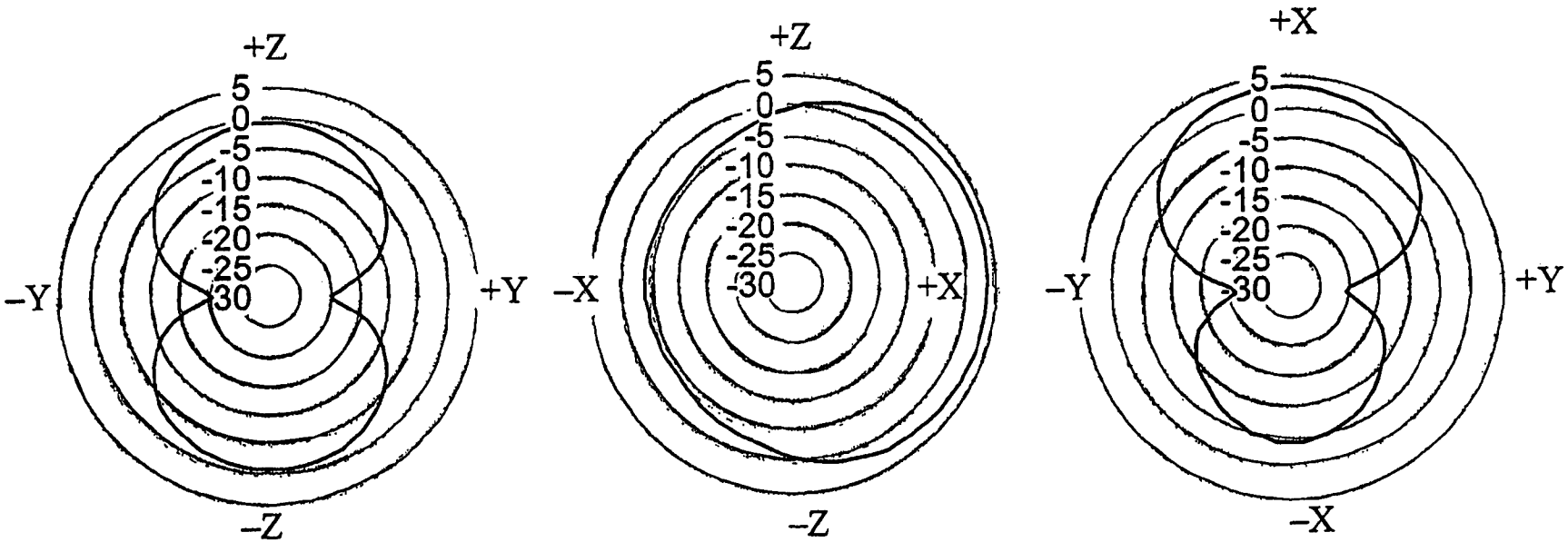
FIGS. 15A to 15C are radiation directivity diagrams of a Fourth Example of the present invention.

In the Fourth Example, the high-frequency switches of each slot structure were controlled so as to realize the fourth control state shown in FIG. 9. A radiation directivity on each coordinate plane in this Example is shown in FIG. 15. As is clear from FIG. 15, it was proven that the fourth control state realizes a radiation which is distributed in the XZ plane, in particular radiation characteristics such that a main beam direction being oriented in the +X direction. In the Y axis direction, a strong gain suppression effect exceeding 25 dB was obtained relative to the gain in the main beam direction.

Fifth Example

Figure 16C:
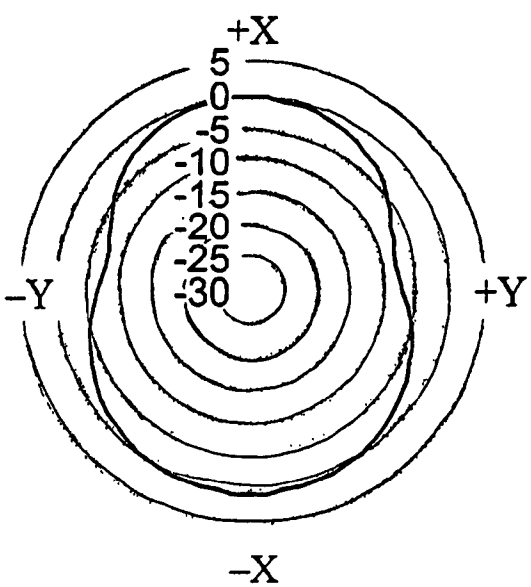
FIGS. 16A to 16C are radiation directivity diagrams of a Fifth Example of the present invention.
Figure 16B:
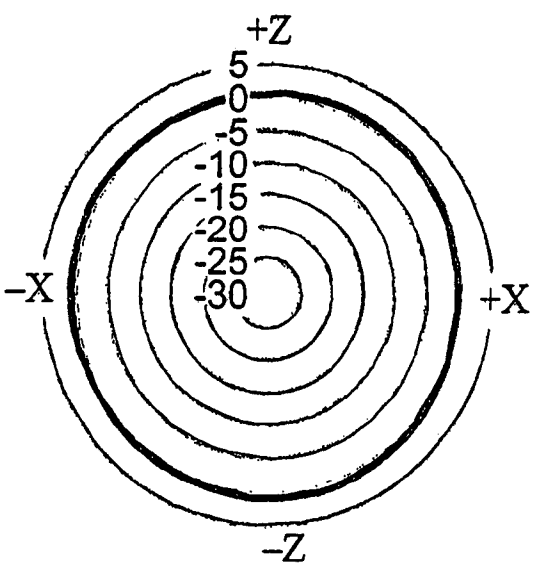
Figure 16A:
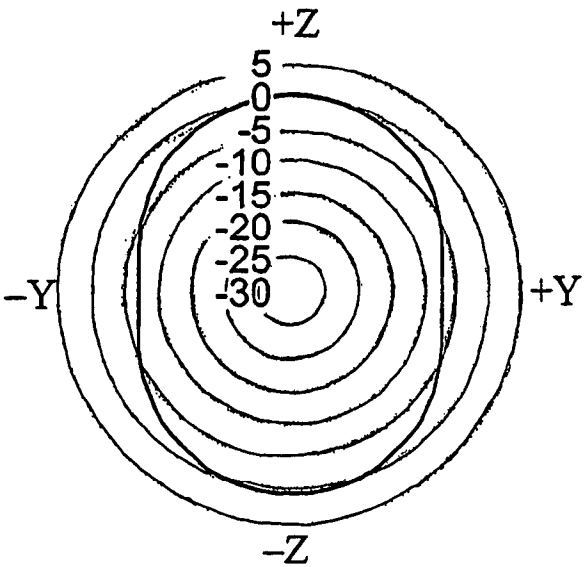
Figure 20A:
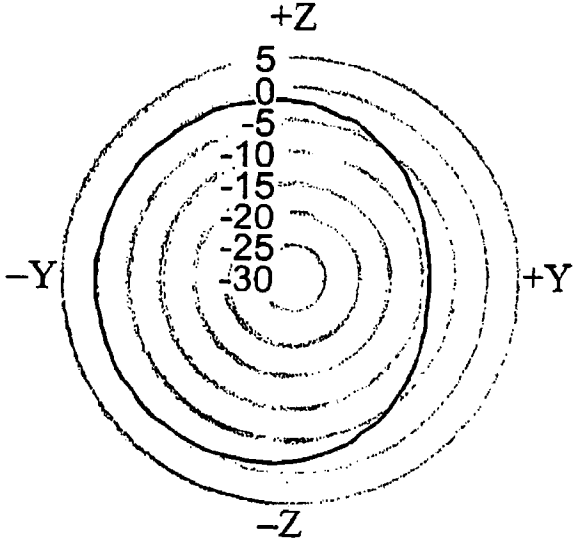
FIGS. 20A and 20B are radiation directivity characteristics diagrams of Conventional Example 1.
Figure 20B:
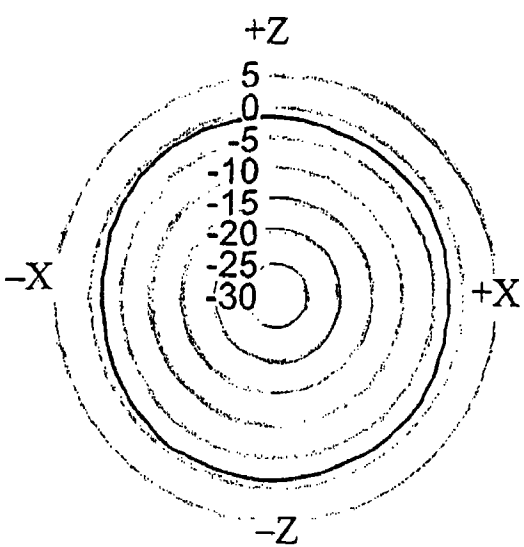
Figure 20C:
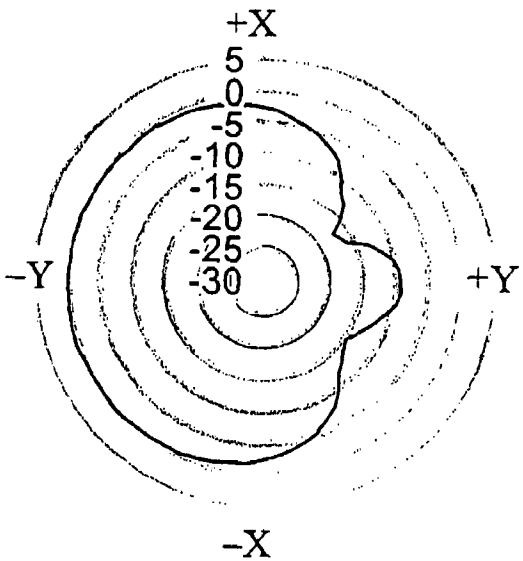
FIG. 20C is a radiation directivity characteristics diagram in the XY plane.
Figure 21A:
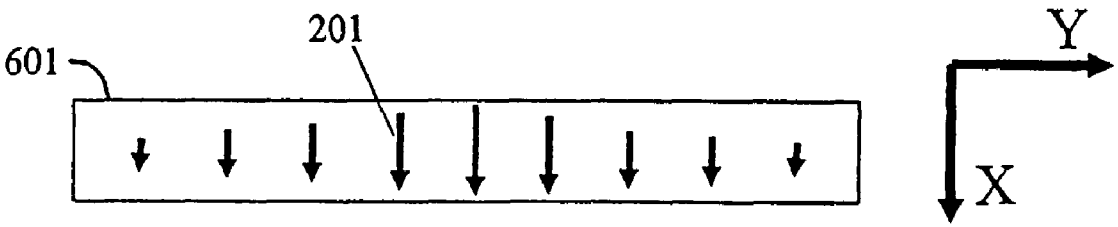
FIGS. 21A and 21B are schematic diagrams of field vector distributions within a ½ wavelength slot resonator.
Figure 21B:
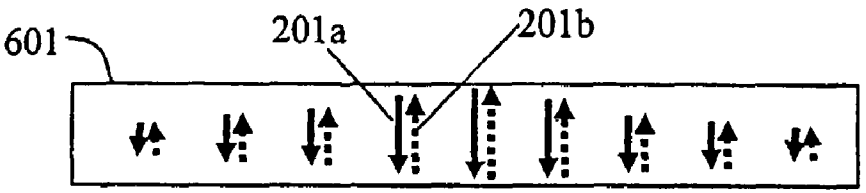

In the Fifth Example, the high-frequency switches of each slot structure were controlled so as to realize the fifth control state shown in FIG. 10. A radiation directivity on each coordinate plane in this Example is shown in FIG. 16. As is clear from FIG. 16, it was proven that the fifth control state realizes broad radiation characteristics distributed in the XZ plane. Unlike in the fourth control state, radiation characteristics were realized such that only a gain decrease of about 7 dB was obtained in the Y axis direction, relative to the gain in the main beam direction.

The differentially-fed variable directivity slot antenna according to the present invention is able to perform efficient radiations in various directions, including directions in which radiation is difficult to be provided by conventional differentially-fed antennas. Not only is it possible to realize a variable directivity antenna that encompasses all solid angles based on a wide range of angles in which the main beam direction is switchable, but it is also possible, according to natural principles, to suppress directivity gains in directions which are orthogonal to the main beam direction.

Furthermore, for the radiation characteristics which are realized in a given control state, it is possible to obtain complementary radiation characteristics in another control state, according to natural principles. Thus, the present invention is useful for the purpose of realizing high-speed communications in indoor environments with profuse multipaths, in particular. The present invention is not only applicable to a wide range of purposes pertaining to the field of communications, but can also be used in various fields employing wireless technology, e.g., wireless power transmission and ID tags.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A differentially-fed variable directivity slot antenna comprising:

a dielectric substrate (101);

a ground conductor (105) provided on a rear face of the dielectric substrate (101), the ground conductor having a finite area;

a differential feed line (103*c*) disposed on a front face of the dielectric substrate (101), the differential feed line having two mirror symmetrical signal conductors (103*a*, 103*b*); and at least one slot structure (601, 605), wherein, the at least one slot structure (601, 605) is formed on the rear face of the dielectric substrate (101);

the at least one slot structure (601, 605) each includes a feeding portion (601*a*, 605*a*), a first selective radiation portion group, and a second selective radiation portion group;

the first selective radiation portion group includes at least one first selective radiation portion (601*b*, 601*c*, 605*b*, 605*c*);

the second selective radiation portion group includes at least one second selective radiation portion (603*b*, 603*c*, 607*b*, 607*c*);

the feeding portion (601*a*, 605*a*) includes a slot provided on the rear face of the dielectric substrate (101);

the at least one first selective radiation portion (601*b*, 601*c*, 605*b*, 605*c*) each includes a slot provided on the rear face of the dielectric substrate;

the at least one second selective radiation portion (603*b*, 603*c*, 607*b*, 607*c*) each includes a slot provided on the rear face of the dielectric substrate;

the feeding portion (601*a*, 605*a*) intersects both signal conductors (103*a*, 103*b*);

the at least one first selective radiation portion (601*b*, 601*c*, 605*b*, 605*c*) is each connected to one end of the feeding portion (601*a*, 605*a*);

a leading end of each of the at least one first selective radiation portion (601*b*, 601*c*, 605*b*, 605*c*) is an open-end point (601*bop*, 601*cop*, 605*bop*, 605*cop*) which is left open;

the at least one second selective radiation portion (603*b*, 603*c*, 607*b*, 607*c*) is each connected to another end of the feeding portion (601*a*, 605*a*);

a leading end of each of the at least one second selective radiation portion (603*b*, 603*c*, 607*b*, 607*c*) is an open-end point (603*bop*, 603*cop*, 607*bop*, 607*cop*) which is left open; and the at least one slot structure (601, 605) has at least one function of an RF structure reconfigurability function and an operation status switching function, thus realizing two or more different radiation directivities, wherein, in between places where the feeding portion intersects the signal conductors (103*a*, 103*b*), the feeding portion (601*a*, 605*a*) further includes a stub (601*s*, 605*s*) having a length which is less than a ⅛ effective wavelength at an operating frequency fo;

between the one end of the feeding portion (601*a*, 605*a*) and the at least one first selective radiation portion (601*b*, 601*c*, 605*b*, 605*c*), a high-frequency switch (601*d*, 601*e*, 605*d*, 605*e*) is inserted so as to straddle the slot structure (601, 605) along a width direction;

between the other end of the feeding portion (601*a*, 605*a*) and the at least one second selective radiation portion (603*b*, 603*c*, 607*b*, 607*c*), a high-frequency switch (603*d*, 603*e*, 607*d*, 607*e*) is inserted so as to straddle the slot structure (601, 605) along the width direction;

each high-frequency switch (601*d*, 601*e*, 603*d*, 603*e*, 605*d*, 605*e*, 607*d*, 607*e*) provides control as to whether or not to short-circuit the ground conductor (105) on both sides bridged by the high-frequency switch;

the RF structure reconfigurability function is realized when a slot resonator with open both ends is formed by the first selective radiation portion (601*b*, 601*c*, 605*b*, 605*c*) selected via the high-frequency switch from within the first selective radiation portion group, the feeding portion, and the second selective radiation portion (603*b*, 603*c*, 607*b*, 607*c*) selected via the high-frequency switch from within the second selective radiation portion group, the slot resonator with open both ends having a slot length corresponding to a ½ effective wavelength at the operating frequency fo; and the operation status switching function is realized by the high-frequency switches short-circuiting the slot structure.

2. The differentially-fed variable directivity slot antenna of claim 1, wherein the differential feed line intersects the feeding portion at a point whose distance from an open end of the differential feed line toward the feed circuit corresponds to a ¼ effective wavelength at the operating frequency.

3. The differentially-fed variable directivity slot antenna of claim 1, wherein an end point of the differential feed line is grounded via resistors of a same resistance value.

4. The differentially-fed variable directivity slot antenna of claim 1, wherein an end point of the first signal conductor and an end point of the second signal conductor are electrically connected to each other via a resistor.

5. The differentially-fed variable directivity slot antenna of claim 1 having two slot structures, wherein, a plane parallel to the dielectric substrate (101) is defined as an XY plane;

a normal direction of the dielectric substrate (101) is defined as a Z axis direction;

the XY plane includes an X axis and a Y axis which are orthogonal to each other;

in each slot structure (601•605), the first selective radiation portion group includes a selective radiation portion (601*b*•605*b*) parallel to the X axis and a selective radiation portion (601*c*•605*c*) parallel to the Y axis;

in each slot structure (601•605), the second selective radiation portion group includes a selective radiation portion (603*b*•607*b*) parallel to the X axis and a selective radiation portion (603*c*•607*c*) parallel to the Y axis;

the open-end point (601*bop*) of the selective radiation portion (601*b*) which is included in the first selective radiation portion group in the first slot structure (601) and which is parallel to the X axis and the open-end point (603*bop*) of the selective radiation portion (603*b*) which is included in the second selective radiation portion group in the first slot structure (601) and which is parallel to the X axis are disposed at a distance of less than a ¼ effective wavelength at the frequency fo from each other;

the open-end point (605*bop*) of the selective radiation portion (605*b*) which is included in the first selective radiation portion group in the second slot structure (605) and which is parallel to the X axis and the open-end point (607*bop*) of the selective radiation portion (607*b*) which is included in the second selective radiation portion group in the second slot structure (605) and which is parallel to the X axis are disposed at a distance of less than a ¼ effective wavelength at the frequency fo from each other;

the open-end point (601*bop*) of the selective radiation portion (601*b*) which is included in the first selective radiation portion group in the first slot structure (601) and which is parallel to the X axis and the open-end point (605*bop*) of the selective radiation portion (605*b*) which is included in the first selective radiation portion group in the second slot structure (605) and which is parallel to the X axis are disposed so as to be apart by about ½ effective wavelength at the frequency fo; and the open-end point (603*bop*) of the selective radiation portion (603*b*) which is included in the second selective radiation portion group in the first slot structure (601) and which is parallel to the X axis and the open-end point (607*bop*) of the selective radiation portion (607*b*) which is included in the second selective radiation portion group in the second slot structure (605) and which is parallel to the X axis are disposed so as to be apart by about ½ effective wavelength at the frequency fo, whereby one of the two or more different radiation directivities is realized, wherein the one radiation directivity is a radiation directivity being orthogonal to the differential feed line and having radiation components in two directions which are parallel to the dielectric substrate.

6. The differentially-fed variable directivity slot antenna of claim 1 having two slot structures, wherein, a plane parallel to the dielectric substrate (101) is defined as an XY plane;

a normal direction of the dielectric substrate (101) is defined as a Z axis direction;

the XY plane includes an X axis and a Y axis which are orthogonal to each other;

in each slot structure (601•605), the first selective radiation portion group includes a selective radiation portion (601*b*•605*b*) parallel to the X axis and a selective radiation portion (601*c*•605*c*) parallel to the Y axis;

in each slot structure (601•605), the second selective radiation portion group includes a selective radiation portion (603*b*•607*b*) parallel to the X axis and a selective radiation portion (603*c*•607*c*) parallel to the Y axis;

the open-end point (601*cop*) of the selective radiation portion (601*c*) which is included in the first selective radiation portion group in the first slot structure (601) and which is parallel to the Y axis and the open-end point (603*cop*) of the selective radiation portion (603*c*) which is included in the second selective radiation portion group in the first slot structure (601) and which is parallel to the Y axis are disposed so as to be apart by about ½ effective wavelength at the frequency fo;

the open-end point (605*cop*) of the selective radiation portion (605*c*) which is included in the first selective radiation portion group in the second slot structure (605) and which is parallel to the Y axis and the open-end point (607*cop*) of the selective radiation portion (607*c*) which is included in the second selective radiation portion group in the second slot structure (605) and which is parallel to the Y axis are disposed so as to be apart by about ½ effective wavelength at the frequency fo;

the open-end point (601*cop*) of the selective radiation portion (601*c*) which is included in the first selective radiation portion group in the first slot structure (601) and which is parallel to the Y axis and the open-end point (605*cop*) of the selective radiation portion (605*c*) which is included in the first selective radiation portion group in the second slot structure (605) and which is parallel to the Y axis are disposed at a distance of less than a ¼ effective wavelength at the frequency fo from each other; and the open-end point (603*cop*) of the selective radiation portion (603*c*) which is included in the second selective radiation portion group in the first slot structure (601) and which is parallel to the Y axis and the open-end point (607*cop*) of the selective radiation portion (607*c*) which is included in the second selective radiation portion group in the second slot structure (605) and which is parallel to the Y axis are disposed at a distance of less than a ¼ effective wavelength at the frequency fo from each other, whereby one of the two or more different radiation directivities is realized, wherein the one radiation directivity is a radiation directivity having radiation components in two directions which are parallel to the differential feed line.

7. The differentially-fed variable directivity slot antenna of claim 1 having two slot structures, wherein, a plane parallel to the dielectric substrate (101) is defined as an XY plane;

a normal direction of the dielectric substrate (101) is defined as a Z axis direction;

the XY plane includes an X axis and a Y axis which are orthogonal to each other;

in each slot structure (601•605), the first selective radiation portion group includes a selective radiation portion (601*b*•605*b*) parallel to the X axis and a selective radiation portion (601*c*•605*c*) parallel to the Y axis;

in each slot structure (601•605), the second selective radiation portion group includes a selective radiation portion (603*b*•607*b*) parallel to the X axis and a selective radiation portion (603*c*•607*c*) parallel to the Y axis;

each high-frequency switch in the first slot structure (601) short-circuits the ground conductor (105) on both sides bridged by the high-frequency switch; and the open-end point (605*cop*) of the selective radiation portion (605*c*) which is included in the first selective radiation portion group in the second slot structure (605) and which is parallel to the Y axis and the open-end point (607*cop*) of the selective radiation portion (607*c*) which is included in the second selective radiation portion group in the second slot structure (605) and which is parallel to the Y axis are disposed so as to be apart by about ½ effective wavelength at the frequency fo, whereby, a radiation gain in a first direction connecting the first open-end point and the second open-end point is suppressed; a main beam is directed in a direction within a plane which is orthogonal to the first direction; and one of the two or more different radiation directivities is realized.

8. The differentially-fed variable directivity slot antenna of claim 1 having two slot structures, wherein, a plane parallel to the dielectric substrate (101) is defined as an XY plane;

a normal direction of the dielectric substrate (101) is defined as a Z axis direction;

the XY plane includes an X axis and a Y axis which are orthogonal to each other;

in each slot structure (601•605), the first selective radiation portion group includes a selective radiation portion (601*b*•605*b*) parallel to the X axis and a selective radiation portion (601*c*•605*c*) parallel to the Y axis;

in each slot structure (601•605), the second selective radiation portion group includes a selective radiation portion (603*b*•607*b*) parallel to the X axis and a selective radiation portion (603*c*•607*c*) parallel to the Y axis;

each high-frequency switch in the second slot structure (605) short-circuits the ground conductor (105) on both sides bridged by the high-frequency switch;

the open-end point (601*cop*) of the selective radiation portion (601*c*) which is included in the first selective radiation portion group in the first slot structure (601) and which is parallel to the Y axis and the open-end point (603*cop*) of the selective radiation portion (603*c*) which is included in the second selective radiation portion group in the first slot structure (601) and which is parallel to the Y axis are disposed so as to be apart by about ½ effective wavelength at the frequency fo, whereby, a radiation gain in a first direction connecting the first open-end point and the second open-end point is suppressed; a main beam is directed in a direction within a plane which is orthogonal to the first direction; and one of the two or more different radiation directivities is realized.

9. The differentially-fed variable directivity slot antenna of claim 1 having two slot structures, wherein, a plane parallel to the dielectric substrate (101) is defined as an XY plane;

a normal direction of the dielectric substrate (101) is defined as a Z axis direction;

the XY plane includes an X axis and a Y axis which are orthogonal to each other;

in each slot structure (601•605), the first selective radiation portion group includes a selective radiation portion (601*b*•605*b*) parallel to the X axis and a selective radiation portion (601*c*•605*c*) parallel to the Y axis;

in each slot structure (601•605), the second selective radiation portion group includes a selective radiation portion (603*b*•607*b*) parallel to the X axis and a selective radiation portion (603*c*•607*c*) parallel to the Y axis;

each high-frequency switch in the second slot structure (605) short-circuits the ground conductor (105) on both sides bridged by the high-frequency switch; and the open-end point (601*bop*) of the selective radiation portion (601*b*) which is included in the first selective radiation portion group in the first slot structure (601) and which is parallel to the X axis and the open-end point (603*bop*) of the selective radiation portion (603*b*) which is included in the second selective radiation portion group in the first slot structure (601) and which is parallel to the X axis are disposed so as to be apart by about ½ effective wavelength at the frequency fo, whereby, a main beam is directed in a direction within a plane which is orthogonal to a first direction connecting the first open-end point and the second open-end point; and one of the two or more different radiation directivities is realized.

* * * * *